US007391994B2

(12) United States Patent
Takada et al.

(10) Patent No.: US 7,391,994 B2
(45) **Date of Patent: *Jun. 24, 2008**

(54) IMAGE FORMING APPARATUS, IMAGE FORMING PROCESS, AND PROCESS CARTRIDGE FOR IMAGE FORMING APPARATUS

(75) Inventors: Takeshi Takada, Yokohama (JP); Takaaki Ikegami, Susono (JP); Akihiro Sugino, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 319 days.

This patent is subject to a terminal disclaimer.

(21) Appl. No.: 11/006,643

(22) Filed: Dec. 8, 2004

(65) Prior Publication Data

US 2005/0130050 A1 Jun. 16, 2005

(30) Foreign Application Priority Data

Dec. 9, 2003 (JP) ..... 2003-409713

(51) Int. Cl.
*G03G 15/00* (2006.01)
*G03G 15/04* (2006.01)

(52) U.S. Cl. ..... 399/159; 430/66

(58) Field of Classification Search ..... 430/66; 399/159

See application file for complete search history.

(56) References Cited

U.S. PATENT DOCUMENTS 4,663,259 A * 5/1987 Fujimura et al. ..... 430/59.6
5,578,405 A 11/1996 Ikegami et al.
5,702,855 A 12/1997 Ikegami et al.
6,030,736 A 2/2000 Ikegami et al.
6,326,111 B1 * 12/2001 Chambers et al. ..... 430/58.05
6,447,966 B1 * 9/2002 Yagi et al. ..... 430/67
6,618,565 B2 9/2003 Tamiya et al.
6,741,821 B2 5/2004 Sugino et al.
6,777,149 B2 8/2004 Ikegami et al.
6,777,150 B2 8/2004 Suzuki et al.

(Continued)

OTHER PUBLICATIONS

U.S. Appl. No. 11/561,983, filed Nov. 21, 2006, Sugino et al.

(Continued)

*Primary Examiner*—Mark F. Huff
*Assistant Examiner*—Peter L Vajda
(74) *Attorney, Agent, or Firm*—Oblon, Spivak, McClelland, Maier & Neustadt, P.C.

(57) ABSTRACT

Disclosed is an image forming apparatus for lowering friction coefficient and lowering surface energy of photoconductor surface in particular, which comprises an electrophotographic photoconductor, charging unit, light exposure unit, developing unit, transferring unit, and fixing unit, the electrophotographic photoconductor comprises a photosensitive layer on a conductive support and fluoropolymer fine particles at the outermost layer, a part of the fluoropolymer fine particles are exposed above the surface of the outermost layer in configurations of primary particles and secondary particles formed by flocculation of plural primary particles, and sum of area ratios of particles in the configurations of the primary particles and the secondary particles, each particles having an average diameter D of 0.15 μm≦D≦3.0 μm as respective projected figures of exposed portion above the surface of the outermost layer, is 10% to 60% based on the entire surface area of the outermost layer, and wherein the binder resin in the outermost layer comprises a polyalylate copolymer resin having a structural unit of alkylene-aryldicarboxylate.

17 Claims, 8 Drawing Sheets

U.S. PATENT DOCUMENTS

| | | | | |
|---|---|---|---|---|
| 6,785,500 | B2 | 8/2004 | Takahashi et al. | |
| 6,816,691 | B2 | 11/2004 | Kabata et al. | |
| 6,824,939 | B2 | 11/2004 | Kurimoto et al. | |
| 6,828,075 | B2 | 12/2004 | Suzuki et al. | |
| 6,829,450 | B2 | 12/2004 | Tamiya et al. | |
| 6,830,858 | B2 | 12/2004 | Sugino et al. | |
| 2003/0077531 | A1* | 4/2003 | Suzuki et al. | 430/66 |
| 2003/0118359 | A1 | 6/2003 | Ogiyama et al. | |
| 2003/0147670 | A1* | 8/2003 | Asano et al. | 399/223 |
| 2003/0194627 | A1 | 10/2003 | Ikegami et al. | |
| 2003/0203296 | A1* | 10/2003 | Law et al. | 430/58.6 |
| 2003/0215726 | A1 | 11/2003 | Sugino et al. | |
| 2004/0028435 | A1 | 2/2004 | Kurimoto et al. | |
| 2004/0115551 | A1 | 6/2004 | Sugiyama et al. | |
| 2004/0121256 | A1 | 6/2004 | Suzuki et al. | |
| 2004/0126687 | A1 | 7/2004 | Ikegami et al. | |
| 2004/0142264 | A1 | 7/2004 | Tanaka et al. | |
| 2004/0180280 | A1 | 9/2004 | Ikegami et al. | |
| 2005/0130050 | A1 | 6/2005 | Takada et al. | |

OTHER PUBLICATIONS

U.S. Appl. No. 11/366,469, filed Mar. 3, 2006, Sugino et al.
U.S. Appl. No. 11/317,302, filed Dec. 27, 2005, Takada et al.
U.S. Appl. No. 11/006,643, filed Dec. 8, 2004, Takada et al.
U.S. Appl. No. 10/804,082, filed Mar. 19, 2004, Tanaka et al.
U.S. Appl. No. 10/804,084, filed Mar. 19, 2004, Takada et al.
U.S. Appl. No. 10/784,872, filed Feb. 24, 2004, Shimada et al.
U.S. Appl. No. 10/802,887, filed Mar. 18, 2004, Tanaka et al.
U.S. Appl. No. 10/893,302, filed Jul. 19, 2004, Sugino et al.
U.S. Appl. No. 10/856,962, filed Jun. 1, 2004, Ikegami et al.
U.S. Appl. No. 10/872,640, filed Jun. 22, 2004, Matsuoka et al.
U.S. Appl. No. 10/879,746, filed Jun. 30, 2004, Takada et al.
U.S. Appl. No. 11/695,750, filed Apr. 3, 2007, Takada et al.
U.S. Appl. No. 11/762,296, filed Jun. 13, 2007, Gondoh et al.
U.S. Appl. No. 11/873,876, filed Oct. 17, 2007, Nakamori et al.
U.S. Appl. No. 11/876,396, filed Oct. 22, 2007, Nakamori et al.
U.S. Appl. No. 11/868,618, filed Oct. 8, 2007, Sugiyama et al.

* cited by examiner

IMAGE FORMING APPARATUS, IMAGE FORMING PROCESS, AND PROCESS CARTRIDGE FOR IMAGE FORMING APPARATUS

BACKGROUND OF THE INVENTION

1. Field of the Invention

The present invention relates to image forming apparatuses, image forming processes, and process cartridges for image forming apparatuses, which are adapted for lowering friction coefficients and lowering surface energies of electrophotographic photoconductors in particular.

2. Description of the Related Art

In the area of electrophotographic processes, various types have been proposed previously (see U.S. Pat. No. 2,297,691, Japanese Patent Application Publication (JP-B) No. 49-23910, and JP-B No. 43-24748, for example). Usually, in electrophotographic processes, electrostatic latent images are formed on photoconductors by various means along with making use of photoconductive substances, the latent images are developed using toner, the toner images are optionally transferred on paper, then the images are fixed by means of heating, pressing, solvent vaporization or the like, and images are formed.

The processes for developing electrostatic latent images are typically classified into liquid-developing processes that utilize a developer, which is usually prepared by dispersing finely various pigments and dyes in insulating organic liquid, and into dry-developing processes such as cascade, magnetic brush, powder cloud processes that utilize a toner, which is usually prepared by preparing a colorant such as carbon black into natural or synthetic resin. Currently, the dry-developing processes are employed broadly.

Recently, fixing at lower temperatures and outputting at higher speed are demanded for saving energy, therefore, thermal energy applied to toner at fixing has been decreasing. The toners for fixing at lower temperatures have been conventionally improved as for the fixing ability at lower temperatures by employing resins or waxes having lower softening temperatures. However, such toners for fixing at lower temperatures are not thermal resistant in general; therefore, they often solidify due to heat from associated apparatuses or heat at the preservation condition, thus so-called blocking or offset is often induced. Accordingly, sufficient temperatures can hardly be assured for such toners; namely, toners for fixing at lower temperatures without such problems have not been attained yet even polyester resins are employed, which exhibit relatively superior thermal preservation ability while affording appropriate fixing ability at lower temperatures. As such, thermal preservation ability and hot offset resistance are nowadays demanded for toners while maintaining lower fixing-initiating temperatures, such demands have been considered as inconsistent previously.

In order to solve such problems, various trials have been conducted; typical trial for producing a toner is such that a polymer having a site reactive with an active-hydrogen-containing compound, a binder resin, a colorant, and a releasing agent are dispersed or dissolved into organic solvent, the solution or dispersion is dispersed into an aqueous medium containing resin fine particles, then allowing to react between the active-hydrogen-containing compound and the polymer having a site reactive with the compound, the organic solvent is removed during or after the reaction, and the reaction product is rinsed and dried; wherein at least two types of resin fine particles are employed, one type provides fixing ability at lower temperatures, another type provides fixing ability at higher temperatures.

Such a toner may satisfy the aforesaid demand at least in part; however, some problems still remain, for example, extraordinary or abnormal images generate due to contaminant deposition or filming, induced possibly by resin fine particles for fixing ability at lower temperatures that may slightly remain on photoconductors; transfer efficiency decreases at transferring toner images on the photoconductor to transferring media, when image forming apparatuses are operated under high temperatures or the temperatures inside apparatuses comes to higher due to continuous operating.

In order to prevent the contaminant deposition such as fused substance onto photoconductor surface, various ways for lowering friction coefficient and surface energy of photoconductor surface have been proposed. As for lowering of friction coefficient as well as lowering surface energy of photoconductor surface, image forming apparatuses are proposed and have been come in practice that have a mechanism to feed lubricant onto photoconductor surface, as described in Japanese Patent Application Laid-Open (JP-A) No. 56-142567, for example. However, such an additional mechanism inevitably leads to enlarged or complicated apparatus, resulting in cost-up and complicated maintenance.

Further, addition of lubricant to surface layer is also proposed for lowering of friction coefficient and surface energy of photoconductor surface as described in JP-A Nos. 52-117134, 53-107841, 54-26740, 54-27434, 54-86340, 54-143142, 54-143148, 56-99345, 56-126838, 57-14845, 57-74748, 57-35863, 57-76553, 57-201240, 58-44444, 58-70229, 58-102949, 58-162958, 59-197042, 62-272281, 62-272282, 63-30850, 63-56658, 63-58352, 63-58450, 63-61255, 63-61256, 63-65449, 63-65450, 63-65451, 63-73267, 63-221355, 63-249152, and 63-311356, for example.

Examples of the lubricants include fluorine-containing resin (hereinafter "fluoropolymer") such as polytetrafluoroethylene, spherical particles of acrylic resin, polyethylene resin powder, metal oxide powders such as silicon oxide and aluminum oxide, and liquid of silicone oil. Fluoropolymers with higher content of fluorine may provide a remarkable effect as lubricant due to their lower surface energy. The fluoropolymers are employed as crystalline fine particles, and formed into a surface layer or protective layer of photoconductors, after being dispersed into a binder resin such as acrylic resins, polyester resins, polyurethane resins, and polycarbonate resins.

However, when the content of fluoropolymer fine particles is relatively low, the friction coefficient tends to rise gradually under repeated image forming, even though the friction coefficient at the photoconductor surface may be decreased initially. On the other hand, the fluoropolymer fine particles tend to flocculate in the dispersion due to the inherent property of fluoropolymer, thus the uniform dispersion may be hardly prepared.

With respect to dispersing fluoropolymer fine particles, numerous investigations have been conducted and variously proposed (see JP-A Nos. 5-45920, 5-265243, 6-130711, 6-332219, and 8-87125, for example).

However, the surface layers that contain fluoropolymer fine particles disclosed in these references are mostly of lower content of fluoropolymer, thus the lower friction coefficient and lower surface energy may not possibly be maintained for long duration. JP-A No. 6-130711 listed above discloses higher content of the fluoropolymer, but any descriptions appear in terms of particle size after dispersion; therefore, finely dispersing seems to be difficult due to the flocculating tendency induced by higher content of fine particles of the fluoropolymer. Coated films formed from such coating liquid often result in excessive irregularity and localized existence of fluoropolymer fine particles on the coated surface. Excessive irregularity of the coated surface often leads to inferior cleaning or deteriorated toner images. Further, the localized fluoropolymer fine particles tend to yield micro areas with higher friction coefficient and higher surface energy and micro areas with lower friction coefficient and lower surface energy at the surface of photoconductors, which often causes inferior cleaning or deteriorated toner images. Moreover, excessively large secondary flocculate size of fluoropolymer fine particles may lead to scattering of laser light on the flocculates, which often causes turbulence of exposed latent images or insufficient potential contrast due to insufficient light amount, resulting in extraordinary or abnormal images.

Further, in the photoconductors that contains fluoropolymer fine particles at the surface region, there is still room in the continuous process in that occurrences of extraordinary images are not completely eliminated such as reduced resolution, void of halftone, and enlarged thin lines, which are estimated to result from lowered resistance of photoconductor surface by fluoropolymer fine particles. For the countermeasure, anti-oxidant agent may be added (see JP-A No. 8-292585 for example); however, a small amount of additive does not exhibit sufficient effect, whereas a large amount of additive may deteriorate electric properties. Further, incorporation of polyalylate resin is proposed as binder resin of the surface layer (see JP-A No. 8-248666 for example); however, conventional mono-component polyalylate resins cannot provide a sufficient effect currently. Accordingly, effective solution against the generation of extraordinary or abnormal images in continuous usage has not been found yet, as such.

SUMMARY OF THE INVENTION

The objects of the present invention are to provide image forming apparatuses, image forming processes, and process cartridges for the image forming apparatuses, in which lower friction coefficient and lower surface energy of photoconductor surface may be maintained even in higher temperature conditions; voids or filming due to contaminant deposition caused by resin fine particles etc. at toner surface may be prevented; and superior images may be formed during prolonged period without extraordinary or abnormal images.

As the results of considerably numerous investigations, we have found that the objects may be achieved by image forming apparatuses that comprise:

an electrophotographic photoconductor, a charging unit configured to charge the electrophotographic photoconductor, a light exposure unit configured to expose light onto the charged electrophotographic photoconductor to form a latent electrostatic image, a developing unit loaded with a toner and configured to visualize the latent electrostatic image by depositing the toner to form a visual image, a transferring unit configured to transfer the visual image onto a recording medium, and a fixing unit configured to fix the visual image transferred onto the recording medium, wherein the toner is produced by dissolving or dispersing a polymer having a site reactive with an active-hydrogen-containing compound, a binder resin, a colorant, and a releasing agent into organic solvent to form a solution or dispersion, dispersing the solution or dispersion into an aqueous medium containing two or more types of resin fine particles, causing the reaction of the polymer having a site reactive with an active-hydrogen-containing compound with the active-hydrogen-containing compound, removing the organic solvent during or after the reaction, and rinsing and drying the reaction product, wherein the toner bears two or more types of resin fine particles on the toner surface, the two or more types of resin fine particles comprise resin fine particle (A) of which the glass transition temperature $T_A$ is highest and resin fine particle (B) of which the glass transition temperature $T_B$ is lowest among the two or more types of resin fine particles, and $T_A$ minus $T_B$ is 20° C. to 150° C., wherein the electrophotographic photoconductor comprises a photosensitive layer on a conductive support and fluoropolymer fine particles at the outermost layer, a part of the fluoropolymer fine particles are exposed above the surface of the outermost layer in configurations of primary particles and secondary particles formed by flocculation of plural primary particles, and sum of area ratios of particles in the configurations of the primary particles and the secondary particles, each particles having an average diameter D of 0.15 μm≦D≦3.0 μm as respective projected figures of exposed portion above the surface of the outermost layer, is 10% to 60% based on the entire surface area of the outermost layer, and wherein the binder resin in the outermost layer comprises a polyalylate copolymer resin having a structural unit of alkylene-aryldicarboxylate.

The reason is not clear, but is considered that the surface of the electrophotographic photoconductor is lowered in the friction coefficient and lower surface energy, therefore, adhesion of small amounts of resin fine particles in the toner onto photoconductor surface may be prevented; further, the polyalylate copolymer resin with higher wear resistance may bring about the condition that the polyalylate copolymer resin covers fluoropolymer fine particles with the aid of higher compatibility with fluoropolymer; thereby lowering of resistance near the fluoropolymer fine particles may be suppressed while maintaining the wear resistance.

In accordance with the present invention, image forming apparatuses, image forming processes, and process cartridges for the image forming apparatuses may be provided, in which lower friction coefficient and lower surface energy of photoconductor surface may be maintained even in higher temperature conditions; voids or filming due to contaminant deposition caused by resin fine particles and the like at toner surface may be prevented; and superior images may be formed during prolonged period without extraordinary or abnormal images.

In an aspect of the present invention, the polyalylate copolymer resin having a structural unit of alkylene-aryldicarboxylate is the polyalylate copolymer resin expressed by the general formula (I):

(I)

$$\left[\left(-\overset{O}{\overset{\|}{C}}-Ar_1-\overset{O}{\overset{\|}{C}}-O-X-O-\right)_l \Big/ \left(-\overset{O}{\overset{\|}{C}}-Ar_2-\overset{O}{\overset{\|}{C}}-O-Ar_3-O-\right)_m\right]_n$$

in the above formula (I), $Ar_1$, $Ar_2$, and $Ar_3$ are each a substituted or unsubstituted aryl group, X is an alkylene group, said substituent group is a halogen atom or alkyl group; l and m are each a mole ratio in relation of $0.05 \leqq l < 0.6$, $0.4 \leqq m < 0.95$, $l+m=1$; n is a positive integer that satisfies the copolymer to have a weight-averaged molecular weight of $1\times10^3$ to $1\times10^6$ in terms of polystyrene.

In an another aspect of the present invention, the polyalylate copolymer resin having a structural unit of alkylene-aryldicarboxylate is the polyalylate copolymer resin expressed by the general formula (II):

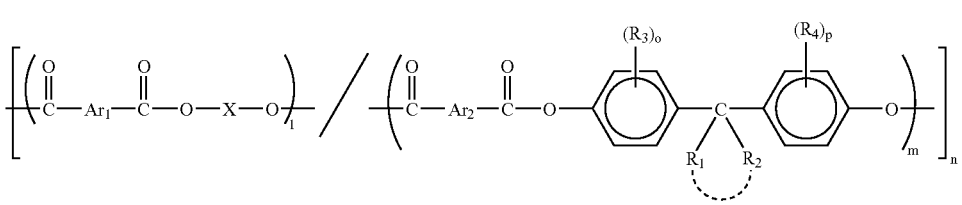

(II)

in the formula (II), $Ar_1$ and $Ar_2$ are each a substituted or unsubstituted aryl group, X is a divalent alkylene group, said substituent group is a halogen atom or alkyl group; $R_1$ and $R_2$ are each a hydrogen atom, alkyl group, or aryl group; $R_3$ and $R_4$ are each a hydrogen atom, alkyl group, or aryl group; o and p are each an integer of 1 to 4, and may identical or different in case of 2 or more; l and m are each mole ratio in relation of $0.05 \leqq l < 0.6$, $0.4 \leqq m < 0.95$, $l+m=1$; n is a positive integer that satisfies the copolymer to have a weight-averaged molecular weight of $1\times10^3$ to $1\times10^6$ in terms of polystyrene.

DESCRIPTION OF THE PREFERRED EMBODIMENTS

Figure 1:
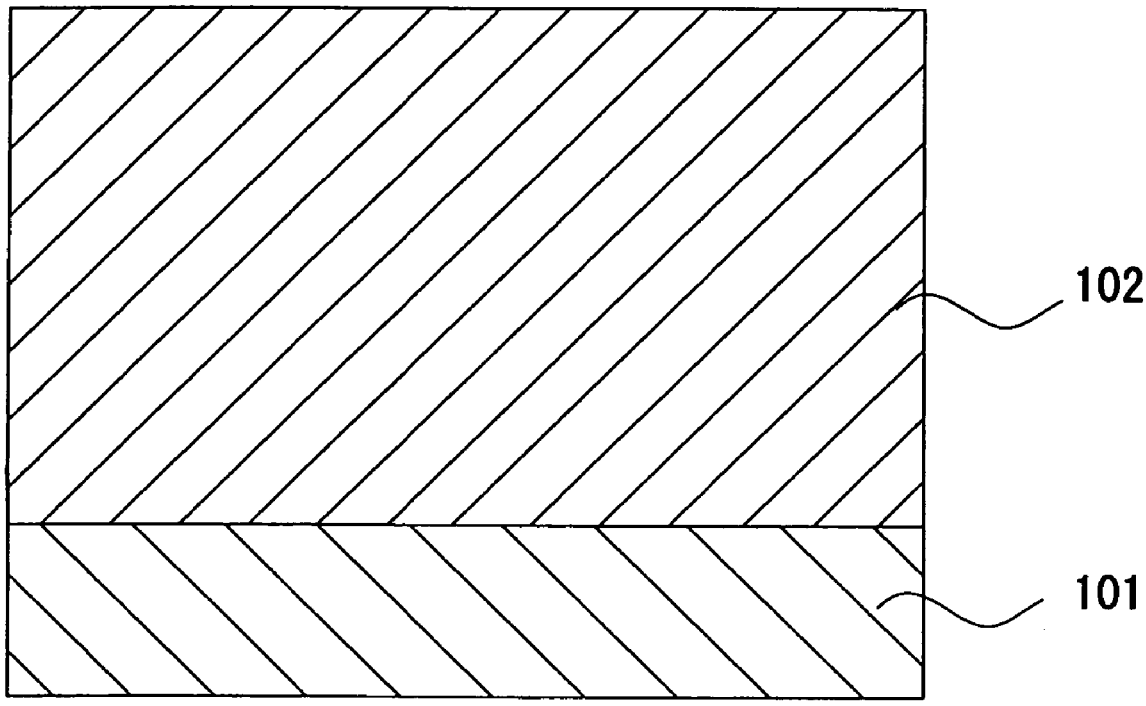
FIG. 1 schematically shows an exemplary layer construction of the electrophotographic photoconductor according to the present invention.

The electrophotographic photoconductor according to the present invention will be explained in the following.

The outermost layer of the electrophotographic photoconductor according to the present invention comprises a polyalylate copolymer resin having a structural unit of alkylene-aryldicarboxylate as binder resin. As for the polyalylate copolymer resin having a structural unit of alkylene-aryldicarboxylate, the entire disclosures of JP-A No. 2002-351113 are expressly incorporated herein by reference.

In general, polyalylate resins refer to polymers having repeated structural units of aryl-aryldicarboxylate expressed by the following general formula (III); typical examples include polyalylate resin obtained from bisphenol A and terephthalic acid expressed by the following general formula (IV).

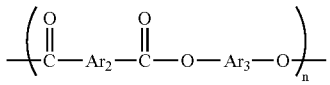

(III)

in the formula (III), $Ar_2$ and $Ar_3$ are each an aryl group; n is a positive integer that satisfies the copolymer to have a weight-averaged molecular weight of $1\times10^3$ to $1\times10^6$ in terms of polystyrene.

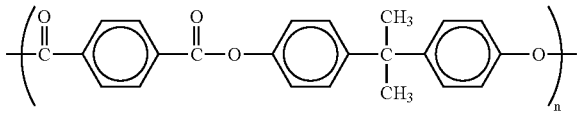

(IV)

in the formula (IV), n is a positive integer that satisfies the copolymer to have a weight-averaged molecular weight of $1\times10^3$ to $1\times10^6$ in terms of polystyrene.

The polyalylate copolymer resin having a structural unit of alkylene-aryldicarboxylate adapted to the present invention comprises a structural unit of alkyl-aryldicarboxylate expressed by the following general formula (V) within the repeated structure of polyalylate resin expressed by the general formula (III) described above.

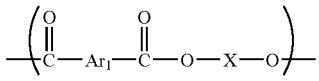

(V)

in the formula (V), $Ar_1$ is a substituted or unsubstituted aryl group, X is a divalent alkyl group, said substituent group is a halogen atom or alkyl group.

The structural unit of alkyl-aryldicarboxylate of formula (V) described above may be derived from aromatic dicarboxylic acid compounds and fatty diol compounds or fatty cyclic ether compound.

The aromatic dicarboxylic acid compounds for producing the structural unit of alkyl-aryldicarboxylate may be derived from aromatic carboxylic acid compounds such as isophthalic acid, terephthalic acid, tetrachlorophthalic acid, chlorophthalic acid, nitrophthalic acid, diphenyl-4,4'-dicarboxylic acid, diphenyl-3,3'-dicarboxylic acid, diphenylmethane-4,4'-dicarboxylic acid, diphenylethane-4,4'-dicarboxylic acid, diphenylpropane-4,4'-dicarboxylic acid, benzophenone-4,4'-dicarboxylic acid, naphthalene-1,4-dicarboxylic acid, naphthalene-1,5-dicarboxylic acid, naphthalene-2,6-dicarboxylic acid, naphthalene-2,7-dicarboxylic acid, diphenylether-4,4'-dicarboxylic acid, diphenylthioether-4,4'-dicarboxylic acid, and diphenylsulfide-4,4'-dicarboxylic acid.

These compounds may be utilized alone or in combination. Particularly, terephthalic acid, isophthalic acid, and mixture thereof are effectively utilized.

The fatty diol compounds for producing the structural unit of alkyl-aryldicarboxylate may be derived from fatty diol compounds such as ethylene glycol, 1,3-propaendiol, 1,4-butanediol, 1,5-pentanediol, 1,6-hexanediol, 1,8-octanediol, 1,10-decanediol, 2-methyl-1,3-propanediol, 2,2-dimethyl-1,3-propanediol, 2-ethyl-1,3-propanediol, diethylene glycol, triethylene glycol, polyethylene glycol, and polytetramethylene etherglycol; and cyclic diol compounds such as 1,4-cyclohexanediol, 1,3-cyclohexanediol, and cyclohexane-1,4-dimethanol. These compounds may be utilized alone or in combination. Particularly, ethylene glycol is effectively utilized. In addition, ethylene oxide, one of fatty cyclic ether compounds, may be employed.

The alylate structure of alylate copolymer resin adapted to the present invention may be represented by the structural unit expressed by the general formula (III), which is derived from aromatic dicarboxylic acid compounds and aromatic diol compounds.

The aromatic dicarboxylic acid compounds having the alylate structure may be derived from aromatic dicarboxylic acid compounds having the structural unit of alkyl-aryldicarboxylate or similar compounds; in particular, terephthalic acid, isophthalic acid, and mixture thereof are effectively utilized.

The aromatic diol component that constitutes the alylate structure may be derived from such compounds as 1,3-benzenediol, 1,4-benzenediol, 1,3-naphthalenediol, 1,2-naphthalenediol, 1,4-naphthalenediol, 1,7-naphthalenediol, 1,6-naphthalenediol, 1,5-naphthalenediol, 1,8-naphthalenediol, 2,3-naphthalenediol, 2,6-naphthalenediol, 2,7-naphthalenediol, 4,4'-dihydroxydiphenyl, 2,2'-dihydroxydiphenyl, 3,3'-dipropyl-4,4'-dihydroxydiphenyl, bis(4-hydroxyphenyl)methane, bis(4-hydroxyphenyl)phenylmethane, bis(4-hydroxyphenyl)diphenylmethane, 1,1-bis(4-hydroxyphenyl)ethane, 1,1-bis(4-hydroxyphenyl)-1-phenylethane, bisphenol A [2,2-bis(4-hydroxyphenyl)propane], 2,2-bis(3-methyl-4-hydroxyphenyl)propane, 2,2-bis(3-chloro-4-hydroxyphenyl)propane, 2,2-bis(3-bromo-4-hydroxyphenyl)propane, 1,1-bis(4-hydroxyphenyl)cyclohexane, 1,1-bis(4-hydroxyphenyl)cyclopentane, 2,2-bis(3-phenyl-4-hydroxyphenyl)propane, 2,2-bis(3-isopropyl-4-hydroxyphenyl)propane, 2,2-bis(4-hydroxyphenyl)butane, 2,2-bis(3,5-dimethyl-4-hydroxyphenyl)propane, 2,2-bis(3,5-dibromo-4-hydroxyphenyl)propane, 4,4'-dihydroxy diphenylsulfone, 4,4'-dihydroxy diphenylsulfoxide, 4,4'-dihydroxy diphenylsulfide, 3,3'-dimethyl-4,4'-dihydroxy diphenylsulfide, 4,4'-dihydroxy diphenyloxide, 2,2-bis(4-hydroxyphenyl)hexafluoropropane, 9,9-bis(4-hydroxyphenyl)fluorene, 9,9-bis(4-hydroxyphenyl)xanthene, and 1,3-bis(4-hydroxyphenyl)tetramethyldisiloxane.

These compounds may be utilized alone or in combination. Particularly, bisphenol compounds are available, specifically bisphenol A is effectively utilized.

As for the polyalylate copolymer resins adapted to the present invention, the combination of aromatic dicarboxylic acids having a structural unit of alkylene-aryldicarboxylate and fatty diol compounds, or the combination of aromatic dicarboxylic acids having an acrylate structural unit and aromatic diol compounds may provide available polyalylate copolymer resins having structures expressed by the general formula (II) below.

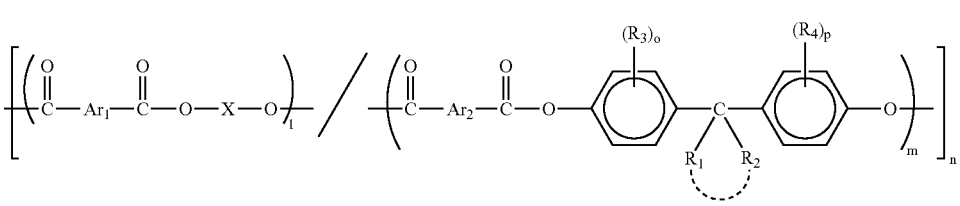

in the formula (II), $Ar_1$ and $Ar_2$ are each a substituted or unsubstituted aryl group, X is a divalent alkylene group, said substituent group is a halogen atom or alkyl group; $R_1$ and $R_2$ are each a hydrogen atom, halogen atom, or alkyl group, and may be cyclic; $R_3$ and $R_4$ are each a hydrogen atom, alkyl group, or aryl group; o and p are each an integer of 1 to 4, and may identical or different in case of 2 or more; 1 and m are each mole ratio in relation of $0.05 \leqq 1 < 0.6$, $0.4 \leqq m < 0.95$, $l+m=1$.

In the structure expressed by formula (II), preferably, $Ar_1$ and $Ar_2$ are each an divalent phenyl group; preferably, the divalent alkylene group X is an ethylene group.

The content of the structural unit of alkyl-aryldicarboxylate depends on the producing process of photoconductor and usage conditions. Excessively high content of the structural unit of alkyl-aryldicarboxylate may decrease the glass transition temperature and softening temperature thus may cause problems such as filming of toner, possibly leading to inappropriate binder resin of photoconductors.

Excessively low content of the structural unit of alkyl-aryldicarboxylate may not exhibit the inventive effect of suppressing extraordinary or abnormal images. The content of the structural unit of alkyl-aryldicarboxylate is preferably 3 to 60% by weight based on the total weight of the polyalylate copolymer resin, preferably is 5 to 40% by weight. Preferably, the mole content of the structural unit of alkyl-aryldicarboxylate is 5 to 60 mol %.

Preferably, the glass transition temperature of the polyalylate copolymer resin adapted to the present invention is 120° C. or more and 170° C. or less; n is a positive integer that satisfies the copolymer to have a weight-averaged molecular weight of $1\times10^3$ to $1\times10^6$, preferably $1\times10^4$ to $1\times10^5$ in terms of polystyrene. The weight-averaged molecular weight of less than $1\times10^3$ often leads to insufficient mechanical strength of the resin itself, and decrease of abrasion resistance in continuous usages; on the other hand, the weight-averaged molecular weight of more than $1\times10^6$ often leads to lower solubility of the resin in coating solvent, resulting in insufficient layer thickness.

Process for Producing Polyalylate

The polyalylate copolymer resin having a structural unit of alkyl-aryldicarboxylate adapted to the present invention may be produced by molten polymerization process, solution polymerization process, or interface polymerization process from dicarboxylic acid compounds, diol compounds or the derivatives that have the structural unit of alkyl-aryldicarboxylate or polyalylate structure; in particular the interface polymerization process may be effectively available. In addition, molten-kneaded process by reaction of ester exchange may be possible from conventional polyalylate resin, entirely formed of aromatic components, and polyester resin such as polyethylene terephthalate that has the structural unit of alkyl-aryldicarboxylate.

Figure 2:
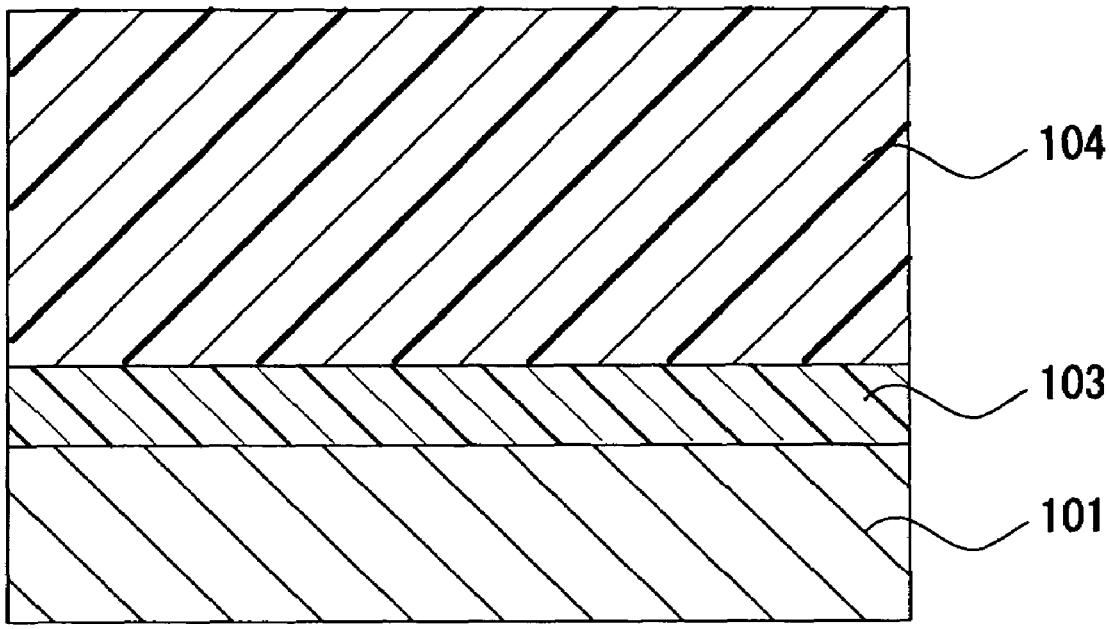
FIG. 2 schematically shows another exemplary layer construction of the electrophotographic photoconductor according to the present invention.
Figure 3:
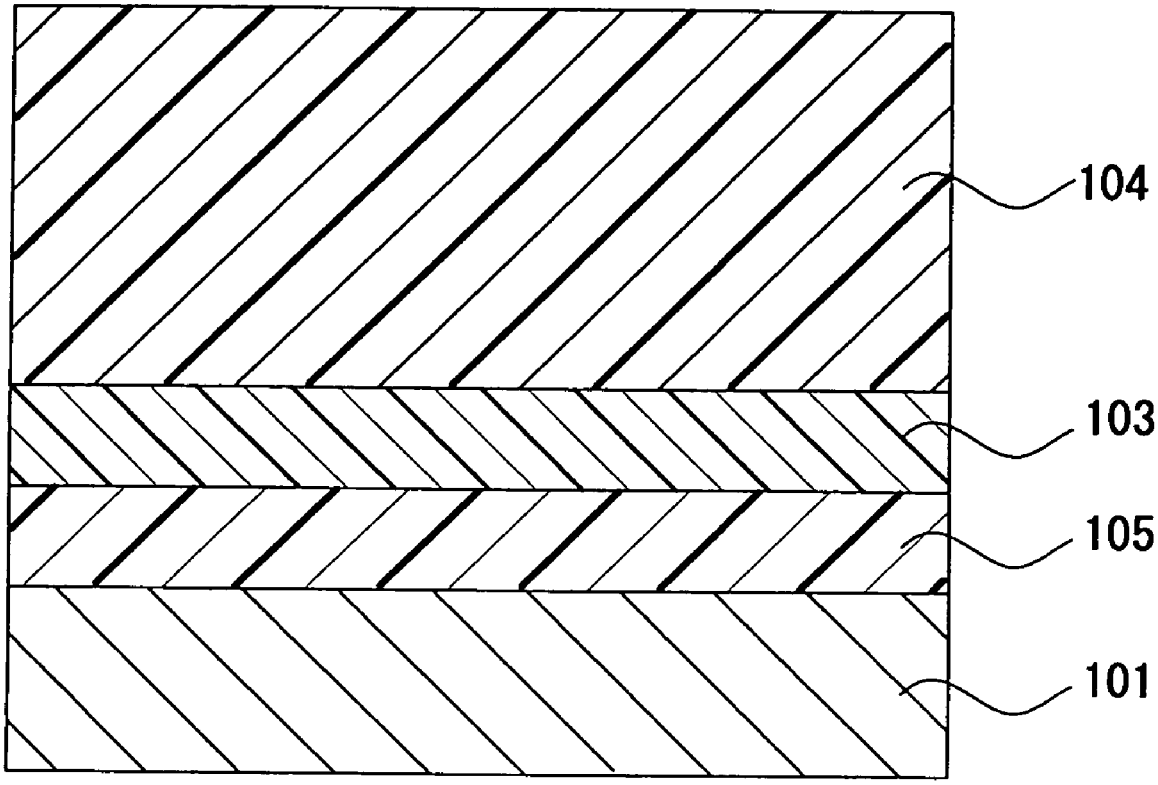
FIG. 3 schematically shows still another exemplary layer construction of the electrophotographic photoconductor according to the present invention.
Figure 4:
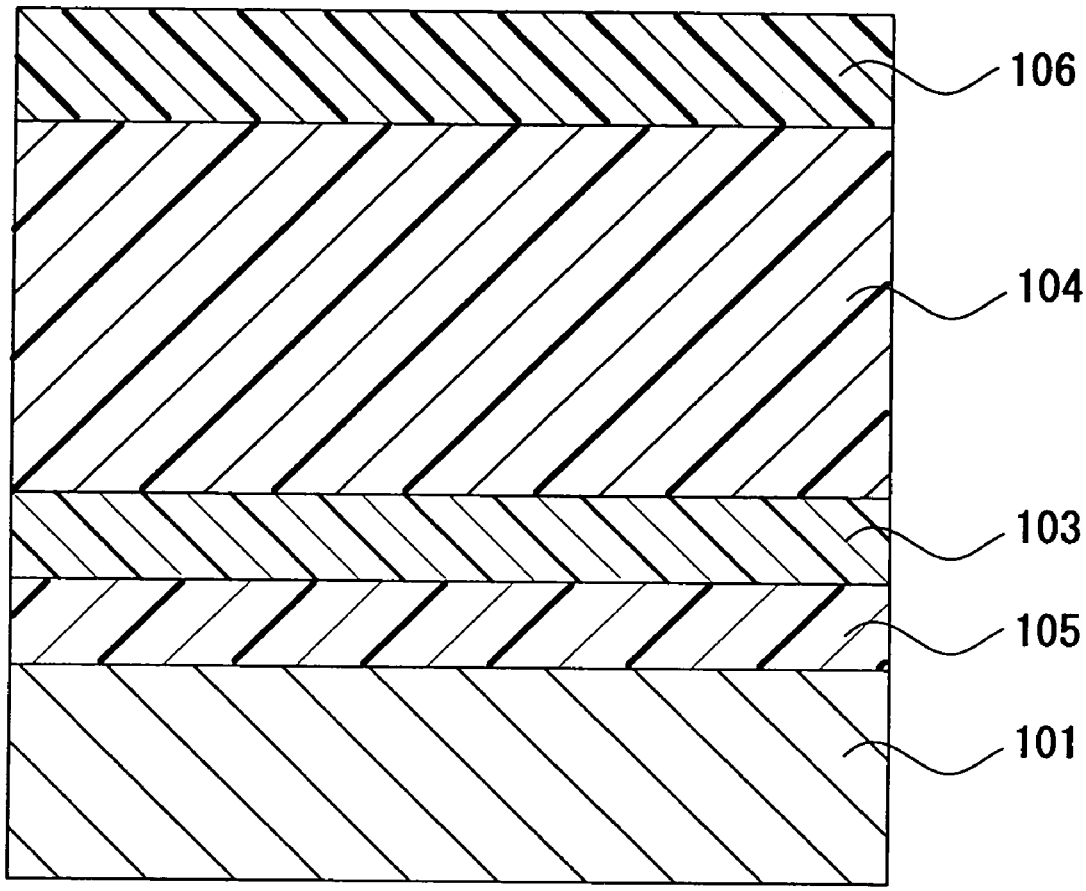
FIG. 4 schematically shows still another exemplary layer construction of the electrophotographic photoconductor according to the present invention.

The present invention will be explained referring to the attached figures. FIG. 1 is a schematical cross section of the electrophotographic photoconductor according to the present invention, showing a construction that photosensitive layer 102 is provided on conductive support 101. FIGS. 2 to 4 show another exemplary layer constructions of the electrophotographic photoconductor according to the present invention.

FIG. 2 shows a function-separated type of electrophotographic photoconductor in which the photosensitive layer is constituted from charge generating layer (CGL) 103 and charge transporting layer (CTL) 104; FIG. 3 shows an electrophotographic photoconductor in which under coating layer 105 is interposed between conductive support 101, and CGL 103 and CTL 104 of the function-separated type of electrophotographic photoconductor. FIG. 4 shows an electrophotographic photoconductor in which protective layer 106 is formed on the photosensitive layer of the type shown in FIG. 3. By the way, the electrophotographic photoconductors adapted to the present invention may comprise the other layers provided that they comprise at least a photosensitive layer on a conductive layer; in addition, any combinations of photosensitive layers are allowable.

The conductive supports, utilized for electrophotographic conductors, adapted to the present invention may be formed of electric conductors such as metal or alloy e.g. Al, Ni, Fe, Cu; conductive-treated electric insulators i.e. composite material of insulating material such as polyester, polycarbonate, polyimide, and glass and thin film of conductive materials, formed on the insulating material, such as Al, Ag, Au, $In_2O_3$, $SnO_2$; composite material of resin and electric conductive material, dispersed into the resin to impart conductivity to the resin, such as carbon black, graphite, Al, Cu, Ni, conductive glass powder; and conductive-treated paper. The shape of the conductive supports is not particularly limited, and may be plate-like, drum-like, or belt-like. The supports of belt-like construction typically require an inside driving roller and related rollers, therefore, often lead to complicated and enlarged apparatuses, while the layout may be advantageously and freely designed. However, when a protective layer is introduced, the surface may be damaged to cracks due to insufficient flexibility, resulting possibly background smear of particulate shape. As such, drum-shape supports are preferred owing to the higher rigidity.

An undercoat layer may be formed between the electric conductive support and the photosensitive layer. The undercoat layer is provided, for example, to improve the adhesion of the photosensitive layer to the substrate, to prevent moire in the resultant image, to improve the coating quality of the upper layer, and to decrease the residual potential of the resultant photoreceptor. The undercoat layer includes a resin as the main component. Since a coating liquid of photosensitive layer, which typically includes an organic solvent, is coated on the undercoat layer, the resin used in the undercoat layer preferably has high resistance to usual organic solvents. Specific examples of such resins for use in the undercoat layer include water-soluble resins such as polyvinyl alcohol, casein and sodium polyacrylate; alcohol-soluble resins such as nylon copolymers, and methoxymethylated nylons; and crosslinkable resins, which form a three dimensional network, such as polyurethane resins, melamine resins, alkyd-melamine resins, and epoxy resins. In addition, the undercoat layer may include a fine powder such as metal oxides, for example, titanium oxide, silica, alumina, zirconium oxide, tin oxide, and indium oxide; metal sulfides, and metal nitrides. The undercoat layer may be formed by conventional methods using an appropriate solvent.

In addition, a metal oxide layer which is formed, for example, by a sol-gel method using a silane coupling agent, titanium coupling agent, or chromium coupling agent may be used as the undercoat layer. Further, a layer of aluminum oxide which is formed by an anodic oxidation method, and a layer of an organic compound such as polyparaxylylene or an inorganic compound such as SiO, $SnO_2$, $TiO_2$, ITO or $CeO_2$, which is formed by a vacuum evaporation method, may be used as the undercoat layer. The thickness of the undercoat layer is preferably from 0.1 to 5 μm.

The photosensitive layer utilized in the present invention may be of Se families or OPC families. Examples of norganic materials for the photosensitive layer include be crystalline selenium, amorphous selenium, selenium-tellurium, selenium-tellurium-halogen, and selenium-arsenic compounds. In particular, OPC families are suitable for environmental and economical issues.

The photosensitive layer utilized in the present invention may be of single layer or laminated layer construction.

At first, the charge generating layers will be explained. The charge generating layers are mainly constituted of charge generating substance and optional binder resin. The charge generating substance may be of inorganic or organic charge generating substances.

Inorganic materials for the charge generating layer may be crystalline selenium, amorphous selenium, selenium-tellurium, selenium-tellurium-halogen, selenium-arsenic compound and the like.

Organic materials for the charge generating layer may be phthalocyanine pigments such as metal phthalocyanine and metal-free phthalocyanine; azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole pigments and the like materials. These charge generating materials may be used alone or in combination.

Specific examples of binder resins utilized optionally in the charge generating layers include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. These resins may be used alone or in combination. One or more charge transporting substances may be included in the charge generating layer, if desired. In addition, polymers of charge transporting substances can be used as a binder resin of the charge generating layer.

Suitable methods for forming the charge generating layer include thin film forming methods in a vacuum, and casting methods. Specific examples of such vacuum thin film forming methods include vacuum evaporation methods, glow discharge decomposition methods, ion plating methods, sputtering methods, reaction sputtering methods, CVD (chemical vapor deposition) methods and the like. Inorganic and organic materials described above can be formed by one of these methods.

The casting methods useful for forming the charge generating layer include, for example, the following steps: preparing a coating liquid by mixing one or more inorganic or organic charge generating substances described above with a solvent such as tetrahydrofuran, cyclohexanone, dioxane, butanone and the like, and if necessary, together with a binder resin and an additive, and then dispersing the materials with a ball mill, an attritor, a sand mill or the like; coating on a substrate the coating liquid, which is diluted if necessary, by a dip coating method, spray coating method, bead coating method or the like; and drying the coated liquid to form a charge generating layer.

The thickness of the charge generating layer is preferably about 0.01 to 5 μm, and more preferably is about 0.05 to 2 μm.

The function of the charge transporting layer is to retain charges formed on the photosensitive layer, and to transport the carriers, which are selectively generated in the charge generating layer by irradiating the photosensitive layer with image-wise light, to couple the carriers with the charges on the photosensitive layer, resulting in formation of an electrostatic latent image on the surface of the photoconductor. Therefore, the charge transporting layer preferably has a high electric resistance to retain charges, and a small dielectric constant, and a large charge mobility to obtain a high surface potential at the charges retained on the photosensitive layer.

In order to satisfy such requirements, the charge transporting layer is mainly constituted of a charge transporting substance together with a binder resin (polycarbonate resin). The charge transporting layer is typically prepared as follows:

(1) a charge transporting substance, a binder resin and an additive are dissolved or dispersed in a solvent such as tetrahydrofuran to prepare a coating liquid; and (2) coating the coating liquid, for example, on the charge generating layer and then drying the coated liquid, resulting in formation of a charge transporting layer.

The charge transporting layer may include an additive such as plasticizer, antioxidant, leveling agent etc., in an amount such that these agents do not deteriorate the characteristics of the charge transporting layer.

The charge transporting substances are classified into positive hole transporting substances and electron transporting substances. Specific examples of the electron transporting substances include electron accepting substances such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, and the like compounds. These electron transporting substances can be used alone or in combination.

Specific examples of the positive hole transporting substances include electron donating substances such as oxazole derivatives, oxadiazole derivatives, imidazole derivatives, triphenylamine derivatives, 9-(p-diethylaminostyrylanthracene), 1,1-bis(4-dibenzylaminophenyl)propane, styrylanthracene, styrylpyrazoline, phenylhydrazone compounds, alpha-phenylstilbene derivatives, thiazole derivatives, triazole derivatives, phenazine derivatives, acridine derivatives, benzofuran derivatives, benzimidazole derivatives, thiophene derivatives and the like. These positive hole transporting substances may be used alone or in combination.

As the charge transporting polymer material, the following charge transport polymers can be used:

(A) Polymers Having Carbazole

Specific examples of such polymers include poly-N-vinyl carbazole, and compounds disclosed in JP-A Nos. 50-82056, 54-9632, 54-11737, 4-175337, 4-183719 and 6-234841.

(B) Polymers Having Hydrazone Skeleton

Specific examples of such polymers include compounds disclosed in JP-A Nos. 57-78402, 61-20953, 61-296358, 1-134456, 1-179164, 3-180851, 3-180852, 3-50555, 5-310904 and 6-234840.

(C) Polysilylene Polymers

Specific examples of such polymers include polysilylene compounds disclosed in JP-A Nos. 63-285552, 1-88461, 4-264130, 4-264131, 4-264132, 4-264133 and 4-289867.

(D) Polymers Having Triaryl Amine Skeleton

Specific examples of such polymers include N,N-bis(4-methylphenyl)-4-aminopolystyrene, and compounds disclosed in JP-A Nos. 1-134457, 2-282264, 2-304456, 4-133065, 4-133066, 5-40350 and 5-202135.

(E) Other Polymers

Specific examples of such polymers include condensation products of nitropyrene with formaldehyde, and compounds disclosed in JP-A Nos. 51-73888, 56-150749, 6-234836 and 6-234837.

The charge transporting polymer material, having an electron donating group, adapted to the present invention is not limited thereto, and known copolymers such as random, block and graft copolymers, and star polymers may also be used. In addition, crosslinking polymers having an electron donating group disclosed in, for example, JP-A No. 3-109406 may also be employed.

Among these charge transporting polymer materials, polycarbonates, polyurethanes, polyesters and polyethers, which have a triaryl amine structure are preferable. Specific examples of such polymer materials are disclosed in JP-A Nos. 64-1728, 64-13061, 64-19049, 4-11627, 4-225014, 4-230767, 4-320420, 5-232727, 7-56374, 9-127713, 9-222740, 9-265197, 9-211877 and 9-304956.

The binder resin may be formed of one resin selected from known resins, alternatively may be formed of two or more of known resins, in the case where the charge transporting layer is not the outermost layer. Examples of such resins include polycarbonates, polyesters, methacrylic resins, acrylic resins, polyethylene, polyvinyl chloride, polyvinyl acetate, polystyrene, phenol resins, epoxy resins, polyurethane, polyvinylidene chloride, alkyd resins, silicone resins, polyvinyl carbazole, polyvinyl butyral, polyvinyl formal, polyacrylate, polyacrylamide, and phenoxy resins.

The film thickness of the charge transporting layer is preferably about 5 to 100 μm, more preferably is about 5 to 30 μm to achieve higher image density of 1200 dpi or more since lower film thickness of charge transporting layers is desired in connection with demands for higher image density in recent years.

In the charge transporting layer adapted to the present invention, such additives as anti-oxidant agent, plasticizer and the like, utilized commercially in rubber, plastic, fatty-oil industries and the like, may be incorporated.

In addition, a leveling agent may be incorporated in the charge transporting layer. The leveling agent may be selected from silicone oils such as dimethyl silicone oils and methyl phenyl silicone oils, and polymers or oligomers having a perfluoroalkyl group in the side chain. The content is preferably 0 to 1 part by weight based on 100 parts by weight of the binder resin.

The coating process may be conventional such as dip coating, spray coating, bead coating and the like.

In the construction that the charge transporting layer is outermost layer of the photoconductor, preferably, the binder resin is the polyalylate copolymer resin having the structural unit of alkylene-aryldicarboxylate, and fluoropolymer fine particles are incorporated in at least the charge transporting layer.

When the fluoropolymer fine particles are incorporated in the charge transporting layer, preferably, the content of the fine particles is increased at the region of near the surface of the charge transporting layer in order to effectively lower the friction coefficient and surface energy. Namely, what exhibit the effect of reducing the friction coefficient as well as surface energy are the fluoropolymer fine particles exposed above the photoconductor surface; the fluoropolymer fine particles should be exist at the area thicker than the threshold of thickness where the photoconductor does not display the performance no longer in order to address the wear of charge transporting layer under the repeated usages. Fluoropolymer fine particles contained inside are possibly useless, and may effect adversely on the electric properties of photoconductors. As for the method for producing photoconductors that contain the fluoropolymer fine particles at near the surface of charge transporting layers, for example, such a method is feasible as applying a coating liquid, being free from fluoropolymer fine particles, for charge transporting layers, then applying another coating liquid filled with fluoropolymer fine particles.

Specifically, the first charge transporting layer is formed initially on the charge generating layer by means of a coating liquid for forming charge transporting layers that is free from fluoropolymer fine particles, then the second charge transporting layer is formed on the first layer by means of a coating liquid for forming charge transporting layers that contains fluoropolymer fine particles at a solid content of about 40% for example, followed by drying, thereby a charge transporting layer may be formed with higher content of the fine particles near the surface. The coating process may be conventional dip coating, spray coating, and the like.

Preferably, the content of fine particles of the fluoropolymer is 20 to 70% by volume, and the fine particles are dispersed near the surface and exposed partly from the surface as defined in the present invention. The content of less than 20% by volume may lead to insufficient durability for lowering the friction coefficient and surface energy due to little projected area of fine particles exposed beyond the surface; the content of more than 70% by volume may inevitably result in low content of binder resin, thus lowering the mechanical strength of the coated film.

Preferably, the primary particle size of the fine particles of the fluoropolymer is not too large as well as not too small, in order to satisfy the preferable average diameter of primary particles and secondary particles. Preferably, the average particle diameter of the primary particles is 0.1 to 0.3 μm.

Next, observations by means of scanning electron microscopes (SEM) will be explained so as to calculate and determine the average diameter and area ratio of projected images of the portions where fine particles of the fluoropolymer are exposed beyond the surface; incidentally, these explanations are not limited to, as long as the exposed conditions of fine particles are observable.

The average diameter, number, and area ratio of fine particles may be determined by taking a picture of the surface of the electrophotographic photoconductor where fine particles of the fluoropolymer are dispersed by means of a SEM, the resulting SEM images are subjected to image analysis in terms of fluoropolymer fine particles. The SEM images for the image analysis are projected from the direction vertical to the surface, therefore, the projected images of fine particles are those from the vertical direction. The average diameter of projected images refers to the averaged value of inner diameters measured every two degrees, wherein respective inner diameters pass through the gravity center, and the average diameter is determined with respect to projected images of particles and flocculates observed as individual particles.

Image analyzers can distinguish the projected images of fine particles from the surrounding binder resin in terms of measurable values. It is necessary to select a condition where one secondary particle formed from plural flocculated primary particles can be approximated as one larger particle; in addition, to prepare a program to calculate at least the average diameter and area ratio with respect to the respective projected images of the fine particles. For example, a specialized apparatus such as High Detail Image Analysis System IP-1000 (Asahi Engineering Co.) and a computer equipped with image analysis software such as Image Pro Plus (Planetron Co.) are representative.

SEM images may occasionally provide inner conditions near the surface as image information when the accelerating voltage is higher. In the material of binder resin and dispersed fine particles, unexposed fluoropolymer fine particles under and near the surface may possibly be observed in a transparent condition when the accelerating voltage is higher; therefore, the accelerating voltage should be adjusted so that the exposed particles beyond the surface can be projected and observed.

In the case of Field Emission Scanning Electron Microscope S-4200 (Hitachi Co.), the accelerating voltage is preferably 2 to 6 kV, which should be adjusted properly depending on the microscope, the material of photoconductor and the like.

The resulting SEM images of surface configuration are introduced into a computer with image analysis software, the average diameters and area ratios of individual fine particles are calculated, thereby the configuration of fine particles at the photoconductor surface can be analyzed and determined.

In a constitution that the charge transporting layer is the outermost layer, the photoconductor may contain filler other than fluoropolymer fine particles at the charge transporting layer.

Filler materials are classified into organic filler materials and inorganic filler materials. Examples of the organic filler materials include silicone resin powder, carbon powder and the like; examples of the inorganic filler materials include metal powders of copper, tin, aluminum, and indium; metal oxides such as silica, tin oxide, zinc oxide, titanium oxide, alumina, zirconium oxide, indium oxide, antimony oxide, bismuth oxide, calcium oxide, tin oxide doped with antimony, and indium oxide doped with tin; metal fluorides such as tin fluoride, calcium fluoride, and aluminum fluoride; and inorganic substances such as potassium titanate and boron nitride, which may be used alone or in combination.

Inorganic filler materials typically exhibit higher hardness than those of organic filler materials, therefore, may provide more efficient improvement in wear resistance in general. By the way, it has been experienced that improvement of latent image bearing member in the wear resistance result in that the surface of the latent image bearing member hardly wears; however, reactive gas such as ozone and $NO_x$, generated at charging, tends to decrease the surface resistance; consequently, the electrostatic charge at the surface gradually comes to be difficult to maintain and the electrostatic charge is likely to move toward the surface.

As a result, the electrostatic latent images tend to bleed, and extraordinary images such as image blur and image flow are often induced when the electrostatic latent images are developed by means of toner. As such, the filler adapted to the present invention has preferably higher resistance such as more than 10 ohm·cm. Such filler may prevent the resistance decrease at outermost surface of photoconductors, and may suppress the occurrences of extraordinary images.

Among the fillers, silica, titanium oxide, and alumina are available in particular. Further, these fillers are commercially available and economical compared to the other fillers, therefore, the production cost of photoconductors may be reduced.

In particular, alpha-alumina of hexagonal crystalline structure that exhibits superior insulating, thermal resistance, and wear resistance properties is advantageous in the view point of suppression of image blur and increase of wear resistance. These fillers may be used alone or in combination.

These filler materials may be dispersed by means of an appropriate dispersing device along with charge transporting substance, binder resin, solvent and the like. The average primary diameter of filler is preferably 0.05 to 1.0 μm, more preferably is 0.1 to 0.3 μm.

The average primary diameter of filler of less than 0.05 μm possibly results in insufficient abrasion resistance. On the other hand, the average primary diameter of filler of more than 1.0 μm possibly results in image blur and/or thicker letters, since the transmittance is decreased due to scattering of writing light by the filler.

Preferably, the content of filler in the surface layer is 5 to 60% by weight in general, and the content depends on the filler and the electrophotographic process conditions of the utilized photoconductor. The filler may be incorporated in the entire charge transporting layer. Preferably, the filler content is inclined such that the filler content is highest at the outermost side of the charge transporting layer and comes to lower toward the conductive support side; or the charge transporting layer is formed from plural layers and the filler content is increased step-wise from conductive support side to the surface side, since the potential at light irradiated portions possibly increases.

Next, photosensitive layers with mono-layer construction will be explained.

In forming photosensitive layers of mono-layer construction by casting process, the photosensitive layers may be formed by dissolving or dispersing charge generating substance and charge transporting substance with lower and/or higher molecular weight into an appropriate solvent, then coating and drying the solution or dispersion. The aforesaid charge generating substances and charge transporting substances are employable.

The photosensitive layer of mono-layer construction may contain a plasticizer if necessary. In addition, a binder resin exemplified in terms of the charge generating layer may be included.

Further, in the construction that the photosensitive layer of mono-layer is the outermost layer of the photoconductor, the binder resin is a polyalylate copolymer resin having the structural unit of alkylene-aryldicarboxylate, and fluoropolymer fine particles are incorporated in the photosensitive layer of mono-layer, and the fluoropolymer fine particles exist in the dispersed condition defined according to the present invention, thereby the same effect as that of the charge transporting layer described before may be obtained.

Further, the photosensitive layer preferably contains higher content of fluoropolymer fine particles at the regions near the surface, similarly to that of the charge transporting layer. The process for forming such content difference is also similar to that of the charge transporting layer.

Preferably, the layer thickness of the photosensitive layer of mono-layer photoconductor is about 5 to 100 μm.

A protective layer may be provided on the photosensitive layer of the inventive photoconductor. The protective layer contains a polyalylate copolymer resin having the structural unit of alkylene-aryldicarboxylate, and may contain the other material. Examples of the other materials include ABS resins, ACS resins, olefin-vinyl monomer copolymers, chlorinated polyether, aryl resins, phenol resins, polyacetal, polyamide, polyamideimide, polyacrylate, polyallylsulfone, polybuthylene, polybuthylene terephthalate, polycarbonate, polyethersulfone, polyethylene, polyethylene terephthalate, polyimide, acryl resins, polymethyl pentene, polypropylene, polyphenyleneoxide, polysulfone, polystyrene, polyalylate, AS resins, butadiene-styrene copolymer, polyurethane, polyvinyl chloride, polyvinylidene chloride, and epoxy resins.

In the construction that a protective layer is employed, fluoropolymer fine particles are incorporated in the protective layer, since the protective layer is the outermost layer. The protective layer is provided mainly in order to enhance the wear resistance. In the present invention, lower friction coefficient and lower surface energy may be maintained even after repeated and prolonged usages by incorporating the fluoropolymer fine particles in properly dispersed condition. Further, since the protective layer may be provided on the photosensitive layer as a relatively thinner layer, the effects on the electric properties of photoconductors are not significant; however, such advantages may possibly be obtained as the content of fine particles of fluoride resin may be increased compared to incorporating the fine particles into the charge transporting layer, or the performance of the protective layer may be distinguished from that of the charge transporting layer by extremely enhancing the lowering of friction coefficient and lowering of surface energy.

Further, the protective layer may contain a filler material in order to further enhance the wear resistance. The filler material may be selected from those described above, and those filler materials may be used alone or in combination.

Further, incorporation of charge transporting substance in the protective layer may be significantly effective for improving photoconductor properties, in particular to decrease the degradation of optical sensitivity and to prevent the increase of residual potential under repeated usages. The reason is considered that the electric charge can move smoothly to the photoconductor surface by imparting the charge transporting property to the protective layer. The charge transporting substance may be those exemplified above for the charge transporting layer.

In addition, the protective layer of the electrophotographic photoconductor may contain various additives in order to improve adhesive property, smoothness, chemical stability and the like.

The protective layer may be formed on the photosensitive layer by means of conventional coating process such as dip coating, spray coating, blade coating, and knife coating. In particular, dip coating and spray coating are preferable from the view point of commercial production and coating quality.

The coating conditions are considerably important, since the dispersed condition of fluoropolymer fine particles varies at the photoconductor surface depending on the various coating condition.

With respect to the conditions in the spray coating, the conditions of coating liquid include concentration of solid content, compounds, and mixed ratio in case of mixed solvent; the conditions of spray device include ejecting velocity of the coating liquid, air pressure for atomizing, distance between the spray tip and the coated surface, moving velocity of coated surface, and coated times, for example.

Specifically, when the ejecting velocity is decreased and the times of over coating are increased thereby the protective layer is formed in the intended thickness, the coated film is formed in relatively dry condition; on the contrary, when the ejecting velocity is increased and the times of over coating are decreased, the coated film is formed in relatively wet condition. As such, any conditions of the coated film during coating process may affect the condition of fluoropolymer fine particles at the surface. Accordingly, various coating conditions should be investigated and determined the appropriate ranges so as to render the fluoropolymer fine particles at the surface as defined in the present invention.

Preferably, the film thickness of the resulting protective layer is 0.1 to 15 μm, more preferably is 1 to 10 μm.

The toner for developing electrostatic images adapted to the present invention will be explained in the following.

Resin Fine Particles

The resin fine particles may be of known resin selected from thermoplastic resins and thermosetting resins, as long as an aqueous dispersion may be formed from the resin fine particles. Examples of the resins include vinyl resins, polyurethane resins, polyester resins, polyamide resins, polyimide resins, silicon resins, phenol resins, melamine resins, urea resins, aniline resins, ionomer resins, and polycarbonate resins. The resin fine particles may be formed of three types or more of these resins. Preferably, the resin is vinyl resin, polyurethane resin, epoxy resin, polyester resin, or combination thereof, since aqueous dispersions of resin fine particles having a spherical shape may be easily produced.

The vinyl resins, which referring to the polymer of polymerized or co-polymerized vinyl monomer, are exemplified by styrene-methacrylate ester resins, styrene-butadiene copolymers, polymers of methacrylate-acrylate ester, styrene-acrylonitrile copolymers, styrene-maleic acid anhydride copolymers, and styrene-methacrylic acid copolymers.

Polymerization of Resin Fine Particles

The polymerization of resin fine particles is exemplified as follows, but not limited to.

In the case of vinyl resin, aqueous dispersion of resin fine particles is prepared directly from monomer(s) as raw material by means of suspension polymerization, emulsion polymerization, seed polymerization, dispersing polymerization or the like.

In the case of polyaddition or condensation resin such as polyester resin, polyurethane resin, and epoxy resin, the precursor such as monomer and oligomer or the solvent solution of the precursor is dispersed into an aqueous medium in the presence of appropriate dispersant, then the precursor is cured by applying heat or adding hardener to prepare an aqueous dispersion of resin fine particles.

In the case of polyaddition or condensation resin such as polyester resin, polyurethane resin, and epoxy resin, the precursor such as monomer and oligomer or the solvent solution of the precursor, preferably being liquid or being made liquid by heating, is compounded an appropriate emulsifier, then is added aqueous medium and emulsified with transferring the phase.

An existing resin prepared by polymerization reaction such as addition polymerization, ring opening polymerization, polyaddition, addition condensation, and condensation polymerization is comminuted by means of a mill such as mechanically rotating type and jet type, then classified to prepare resin fine particles, followed by dispersing the resin fine particles into an aqueous medium in the presence of an appropriate dispersant.

An existing resin prepared by polymerization reaction such as addition polymerization, ring opening polymerization, polyaddition, addition condensation, and condensation polymerization is dissolved into a solvent to form a resin solution, then the resin solution is sprayed mistily to prepare resin fine particles, followed by dispersing the resin fine particles into an aqueous medium in the presence of an appropriate dispersant.

An existing resin prepared by polymerization reaction such as addition polymerization, ring opening polymerization, polyaddition, addition condensation, and condensation polymerization is dissolved into a solvent to form a resin solution, then a bad solvent is added to the resin solution or previously warmed resin solution is cooled thereby to deposit resin fine particles, and the solvent is removed, followed by dispersing the resin fine particles into an aqueous medium in the presence of an appropriate dispersant.

An existing resin prepared by polymerization reaction such as addition polymerization, ring opening polymerization, polyaddition, addition condensation, and condensation polymerization is dissolved into a solvent to form a resin solution, then the resin solution is dispersed into an aqueous medium in the presence of an appropriate dispersant, followed by removing the solvent under heating and/or reduced pressure.

An existing resin prepared by polymerization reaction such as addition polymerization, ring opening polymerization, polyaddition, addition condensation, and condensation polymerization is dissolved into a solvent to form a resin solution, then an appropriate emulsifier is dissolved into the resin solution, followed by emulsifying the resin solution with phase transformation while adding water.

In the polymerization reaction described above, addition and co-polymerization of a monomer having two or more of unsaturated groups in 0.3 to 20 parts by weight may result in solubility alternation against organic solvent, and adjustment of adhesive condition of resin fine particles onto the toner surface. When the content is more than 20 parts by weight, the compatibility between the toner and resin fine particles is insufficient, and the adhesion onto the toner surface is lower.

Glass Transition Temperature

As for the glass transition temperature of the resin fine particles adapted to the present invention, preferably, the glass transition temperature of resin fine particles (A) is 55 to 150° C., and that of resin fine particles (B) is 25 to 100° C. Preferably, the difference between the two glass transition temperatures of the respective resin fine particles is no less than 20° C., more preferably is 25 to 70° C. When the temperature difference is less than the range, the superior properties of resin fine particles (A) and resin fine particles (B) are suppressed to display, possibly resulting in one or more insufficient properties of fixing ability at lower temperatures, offset resistance, and preservation resistance at higher temperatures.

The glass transition temperatures are measured by means of Differential Scanning Calorimeter DSC-60 (Shimadzu Co.); specifically, the temperature is raised from room temperature to 200° C. at a rate of 10° C./min, and is lowered to room temperature at a rate of 10° C./min, then measurements are conducted at a heating rate of 10° C./min, wherein the glass transition temperature is determined from the point where the baseline under the glass transition temperature and the height of baseline (h) of over the glass transition temperature correspond to ½.

The weight ratio (A:B) of resin fine particles (A) and resin fine particles (B) is preferably 10:90 to 50:50, more preferably is 20:80 to 40:60. When the weight ratio of resin fine particles (A) exceed the range, fixing ability at lower temperatures and smoothness of fixed surface tend to diminish, on the other hand, when the weight ratio of resin fine particles (A) is lowered from the range, the offset resistance and the preservation ability at higher temperatures tend to degrade.

Further, compounding of resin fine particles (A) and resin fine particles (B) in the weight ratio may make possible to remain proper amount of fine particles on the toner surface so as to sustain the preservation ability of toner surface at higher temperatures.

In the resin fine particles adapted to the present invention, the weight-averaged molecular weight of tetrahydrofuran-soluble components of fine particles (C) is usually 100,000 to 6,000,000, preferably is 300,000 to 3,000,000, and more preferably is 500,000 to 1,000,000. When the components having molecular weight of 6,000,000 are increased, the fixing ability at lower temperatures tends to degrade. On the other hand, the weight-averaged molecular weight of tetrahydrofuran-soluble components of fine particles (D) is usually 8,000 to 800,000, preferably is 50,000 to 600,000, and more preferably is 100,000 to 400,000. When the components having molecular weight of 6,000,000 are increased, the preservation ability of at higher temperatures tends to degrade. The degradation may be reduced as low as possible by balancing the properties.

The distribution of the components of resin fine particles may be determined by means of GPC as follows. The column is stabilized in a heating chamber at 40° C., tetrahydrofuran is flowed at a velocity of 1 ml/min as the column solvent at the temperature, the sample solution is prepared at a concentration of 0.05 to 0.6 weight % using tetrahydrofuran as the solvent, then the sample solution is injected at an amount of 50 to 200 μL and procedures for measuring are carried out.

In determining the molecular weight of a sample, the molecular weight distribution of the sample is calculated from logarithmic values of analytical curves prepared from plural kinds of monodisperse-polystyrene standard samples and the count values. As for the standard polystyrene samples for preparing the analytical curve, those having molecular weight of $6\times10^2$, $2.1\times10^2$, $4\times10^2$, $1.75\times10^4$, $1.1\times10^5$, $3.9\times10^5$, $8.6\times10^5$, $2\times10^6$, $4.48\times10^6$, are utilized, and at least about ten standard polystyrene samples are employed. As for the detector, RI (refractive index) is employed.

Remaining Condition of Resin Fine Particles

The resin fine particles in the toner are added when producing the toner in order to control the toner configuration such as circularity and particle size distribution. Preferably, the average particle diameter of the resin fine particles is 20 to 400 nm, the BET specific surface area of the resin fine particles is 0.5 to 6.0 $m^2/g$. When the average particle diameter is less than 20 nm, or the BET specific surface area is less than 0.5 $m^2/g$, the organic components of the resin fine particles, remaining on the toner surface, tend to cover the entire surface of the toner, thereby the resin fine particles inhibit the adhesion between the binder resin and the fixing medium, and the lower limit of fixing temperature is likely to rise. Moreover, since the resin fine particles tend to inhibit the bleeding of waxes, the waxes do not display releasing effect and offset often occurs. Further, when the average particle diameter is no less than 400 nm, or the BET specific surface area is no less than 6.0 $m^2/g$, the resin fine particles remaining on the toner surface may protrude considerably as convex portions, alternatively the resin fine particles may remain as multiple layers in rough condition, thereby the resin fine particles also inhibit the adhesion between the binder resin and the fixing medium, and the lower limit of fixing temperature is likely to rise. Moreover, since the resin fine particles tend to inhibit the bleeding of waxes, the waxes do not display sufficiently releasing effect and offset often occurs.

The average particle size of the resin fine particles may be determined by means of Particle Size Distribution Analyzer LA-920 (Horiba Co.). The surface area of toner may be determined based on BET method such that nitrogen gas is adsorbed on sample surface by means of Specific Surface Area Analyzer Autosorb-1 (Yuasa Ionics Inc.), then the surface area may be measured using a multi-plotting method.

Remaining Ratio and Covering Ratio of Resin Fine Particles

In the toner added at producing the toner in order to control the toner configuration such as circularity and particle size distribution, preferably, the remaining ratio of the resin fine particle is 0.5 to 8.0% by weight based on the toner. When the remaining ratio is no more than 0.5% by weight, the shelf stability is inferior, thus blocking appears during storage and inside developing apparatuses; when the remaining ratio is no less than 8.0% by weight, the resin fine particles tend to inhibit the bleeding of waxes, thus the waxes do not display releasing effect and offset often occurs.

The remaining ratio of resin fine particles results from the substance of resin fine particles not from that of toner. The remaining ratio may be determined from the peak area by means of Gas Chromatograph Analyzer based on pyrolysis and mass spectrometry. Preferably, the detector is a mass spectrometry, but not limited to.

Preferably, the covering ratio of resin fine particles over the toner particle surface is 75 to 100%. When the covering ratio is no more than 75%, the shelf stability is inferior, thus blocking appears during storage and inside developing apparatuses. The covering ratio is determined by means of electron microscope photographs and the related Image Analyzer and measured as the ratio of surface area of resin fine particles over the surface area of toner. Specific measuring conditions will be explained later.

Polyester

The polyester compounds (B1) having an isocyanate group can be one prepared, for example, by allowing polyester being as a polycondensate between polyol (1) and a polycarboxylic acid (2) and having an active hydrogen group, to react with polyisocyanate compound (3). The active hydrogen group of the polyester includes, for example, hydroxyl groups (alcoholic hydroxyl groups and phenolic hydroxyl groups), amino groups, carboxyl groups, and mercapto groups, of which alcoholic hydroxyl groups are preferred.

Further, polyester compound (B1) may be selected from conventional polyester resins without particular limitations as long as being soluble into organic solvents; examples thereof include addition polymerization product of polyol (1) and a polycarboxylic acid (2).

Polyol

Polyol (1) may be diol and polyol having trivalent or more, preferably is diol alone, or a mixture of diol and small amount of polycarboxylic acid having trivalent or more. Examples of the diols include alkylene glycols having 2 to 18 carbon atoms such as ethylene glycol, 1,2-propyrene glycol, 1,3-propyrene glycol, 1,4-butane diol, neopentyl glycol, 1,6-hexane diol, dodecane diol; alkylene ether glycol having 4 to 1000 carbon atoms such as diethylene glycol, triethylene glycol, dipropylene glycol, polyethylene glycol, polypropylene glycol, and polytetramethylene etherglycol; alicyclic glycol having 5 to 18 carbon atoms such as 1,4-cyclohexane dimethanol and hydrogenated bisphenol A; bisphenol family such as bisphenol A, bisphenol F, and bisphenol S; adducts of alkylene oxide having 2 to 18 carbon atoms such as ethylene oxide, propylene oxide, butylene oxide, alpha-olefin oxide (added mole number: 2 to 20) to the above described alicyclic diols and bisphenols. Among these, alkylene glycol having 2 to 12 carbon atoms and alkylene oxide adducts of bisphenols having 2 to 18 carbon atoms. Particularly, the combination of alkylene oxide adducts of bisphenols (in particular, 2 to 3 mol of ethylene oxide or propylene oxide added to bisphenol A) and alkylene glycols having 2 to 12 carbon atoms in particular ethylene glycol, 1,2-propyrene glycol, 1,3-propyrene glycol, 1,4-butane diol, and neopentyl glycol.

As for the ratio in the combination, the alkylene oxide adduct of bisphenols is usually 30% by mol or more, preferably is 50% by mol or more, and more preferably is 70% by mol or more. Examples of polyols having trivalent or more include polyvalent fatty alcohols such as glycerin, trimethylol ethane, trimethylol propane, pentaerythritol, and sorbitol; phenols having trivalent to octavalent or more such as trisphenol PA, phenol novolak, and cresol novolak; and alkylene oxide adducts having 2 to 18 carbon atoms of the polyphenols having trivalent or more (added mole number: 2 to 20).

Polycarboxylic Acid

The polycarboxylic acid (2) includes, for example, dicarboxylic acids and trivalent or more of polycarboxylic acids. As the polycarboxylic acid (2), a dicarboxylic acid alone or in combination with a small amount of trivalent or more polycarboxylic acid is preferred. The dicarboxylic acids include, but are not limited to, alkylenedicarboxylic acids such as succinic acid, adipic acid, and sebacic acid; alkenylenedicarboxylic acids such as maleic acid, and fumaric acid; aromatic dicarboxylic acids such as phthalic acid, isophthalic acid, terephthalic acid, and naphthalenedicarboxylic acid. Among them, preferred are alkenylenedicarboxylic acids each having 4 to 20 carbon atoms and aromatic dicarboxylic acids each having 8 to 20 carbon atoms. The trivalent or more polycarboxylic acids include, for example, aromatic polycarboxylic acids each having 9 to 20 carbon atoms, such as trimellitic acid and pyromellitic acid. An acid anhydride or lower alkyl ester (e.g., methyl ester, ethyl ester, and isopropyl ester) of any of the polycarboxylic acids can be used as the polycarboxylic acid (2) to react with the polyol (1).

Ratio of Polyester and NCO

The ratio of the polyol (1) to the polycarboxylic acid (2) in terms of the equivalence ratio [OH]/[COOH] of the hydroxyl groups [OH] to the carboxyl groups [COOH] is generally from 2/1 to 1/1, preferably from 1.5/1 to 1/1, and more preferably from 1.3/1 to 1.02/1. The polyisocyanate (3) includes, but is not limited to, aliphatic polyisocyanates such as tetramethylene diisocyanate, hexamethylene diisocyanate, and 2,6-diisocyanatomethyl caproate; alicyclic polyisocyanates such as isophorone diisocyanate, and cyclohexylmethane diisocyanate; aromatic diisocyanates such as tolylene diisocyanate, and diphenylmethane diisocyanate; aromatic-aliphatic diisocyanates such as $\alpha,\alpha,\alpha',\alpha'$-tetramethylxylylene diisocyanate; isocyanurates; blocked products of the polyisocyanates with, for example, phenol derivatives, oximes, or caprolactams; and mixtures of these compounds. The amount of the polyisocyanate (3) in terms of the equivalence ratio [NCO]/[OH] of isocyanate groups [NCO] to hydroxyl groups [OH] of the polyester is generally from 5/1 to 1/1, preferably from 4/1 to 1.2/1, and more preferably from 2.5/1 to 1.5/1. If the ratio [NCO]/[OH] is more than 5, image-fixing properties at low temperatures may deteriorate. If the ratio [NCO/[OH] is less than 1, a urea content in the modified polyester decreases, and the toner may have deteriorated hot offset resistance. The content of the polyisocyanate (3) in the prepolymer (A) having an isocyanate group is generally from 0.5% by weight to 40% by weight, preferably from 1% by weight to 30% by weight, and more preferably from 2% by weight to 20% by weight. If the content is less than 0.5% by weight, the hot off-set resistance may deteriorate, and satisfactory storage stability at high temperatures and image-fixing properties at low temperatures may not be obtained concurrently. If the content is more than 40% by weight, the image-fixing properties at low temperatures may deteriorate. The prepolymer (A) generally has, in average, 1 or more, preferably 1.5 to 3, and more preferably 1.8 to 2.5 isocyanate groups per molecule. If the number of the isocyanate group per molecule is less than 1, the urea-modified polyester may have a low molecular weight and the hot off-set resistance may deteriorate.

Toner Binder Resin

A colorant for use in the present invention may be a master batch prepared by mixing and kneading a pigment with a resin. Examples of binder resins for use in the production of the master batch or in kneading with the master batch are, in addition to the aforementioned modified and unmodified polyester resins, polystyrenes, poly-p-chlorostyrenes, polyvinyltoluenes, and other polymers of styrene and substituted styrenes; styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl a-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic ester copolymers, and other styrenic copolymers; poly(methyl methacrylate), poly(butyl methacrylate), poly(vinyl chloride), poly(vinyl acetate), polyethylenes, polypropylenes, polyesters, epoxy resins, epoxy polyol resins, polyurethanes, polyamides, poly(vinyl butyral), poly(acrylic acid) resins, rosin, modified rosin, terpene resins, aliphatic or alicyclic hydrocarbon resins, aromatic petroleum resins, chlorinated paraffins, and paraffin waxes. Each of these resins can be used alone or in combination.

Crosslinker and Extension Agent

Amines may be utilized for a crosslinker and/or extension agent.

The amine (B) includes, for example, diamines (B1), trivalent or more polyamines (B2), amine alcohols (B3), aminomercaptans (B4), amino acids (B5), and amino-blocked products (B6) of the amines (B1) to (B5). The diamines (B1) include, but are not limited to, aromatic diamines such as phenylenediamine, diethyltoluenediamine, and 4,4'-diaminodiphenylmethane; alicyclic diamines such as 4,4'-diamino-3,3'-dimethyldicyclohexylmethane, diaminocyclohexanes, and isophoronediamine; and aliphatic diamines such as ethylenediamine, tetramethylenediamine, and hexamethylenediamine. The trivalent or more polyamines (B2) include, for example, diethylenetriamine, and triethylenetetramine.

The amino alcohols (B3) include, but are not limited to, ethanolamine, and hydroxyethylaniline. The aminomercaptans (B4) include, for example, aminoethyl mercaptan, and aminopropyl mercaptan. The amino acids (B5) include, but are not limited to, aminopropionic acid, and aminocaproic acid. The amino-blocked products (B6) of the amines (B1) to (B5) includes ketimine compounds and oxazoline compounds derived from the amines (B1) to (B5) and ketones such as acetone, methyl ethyl ketone, and methyl isobutyl ketone. Among these amines (B), preferred are the diamine (B1) alone or in combination with a small amount of the polyamine (B2).

The molecular weight of the modified polyester can be controlled by using a crosslikking agent and/or an elongation terminator if necessary. Such elongation terminators include, but are not limited to, monoamines such as diethylamine, dibutylamine, butylamine, and laurylamine; and blocked products (ketimine compounds) of these monoamines. The content of the amine (B) in terms of the equivalence ratio [NCO]/[NHx] of isocyanate groups [NCO] in the prepolymer (A) to amino groups [NHx] of the amine (B) is generally from 1/2 to 2/1, preferably from 1/1.5 to 1.5/1 and more preferably from 1.2/1 to 1/1.2. If the ratio [NCO]/[NHx] exceeds 2/1 or is less than 1/2, the urea-modified polyester (i) may have a low molecular weight, and the hot off-set resistance may deteriorate.

The colorant utilized in the present may be selected from inorganic pigments, organic pigments, organic dyes, and combination thereof.

Specifically, carbon black, aniline blue, phthalocyanine blue, phthalocyanine green, Hansa yellow, Rhodamine pigments, chrome yellow, quinacridone, benzidine yellow, rose bengal, triallylmethane dyes, mono-azo pigments, diazo pigments and condensed azo pigments, and combination thereof may be utilized. In the case of full-color toner, preferably, benzidine yellow, mono-azo pigments, and condensed azo pigments are employed for yellow; quinacridone and mono-azo pigments are employed for magenta; and phthalocyanine blue is employed for cyan. Particularly preferred are pigment blue 15:3 for cyan pigment, pigment yellow 74 and pigment yellow 93 for yellow pigment, and quinacridone compounds for magenta. The content of these colorants is preferably 2 to 25 parts by weight based on 100 parts by weight of entire toner components.

A colorant for use in the present invention may be a master batch prepared by mixing and kneading a pigment with a resin. Examples of binder resins for use in the production of the master batch or in kneading with the master batch are, in addition to the aforementioned modified and unmodified polyester resins, polystyrenes, poly-p-chlorostyrenes, polyvinyltoluenes, and other polymers of styrene and substituted styrenes; styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic ester copolymers, and other styrenic copolymers; poly(methyl methacrylate), poly(butyl methacrylate), poly(vinyl chloride), poly(vinyl acetate), polyethylenes, polypropylenes, polyesters, epoxy resins, epoxy polyol resins, polyurethanes, polyamides, poly(vinyl butyral), poly(acrylic acid) resins, rosin, modified rosin, terpene resins, aliphatic or alicyclic hydrocarbon resins, aromatic petroleum resins, chlorinated paraffins, and paraffin waxes. Each of these resins can be used alone or in combination.

The master batch can be prepared by mixing and kneading a resin for master batch and the colorant under high shearing force. In this procedure, an organic solvent can be used for higher interaction between the colorant and the resin. In addition, a "flushing process" is preferably employed, in which an aqueous paste containing the colorant and water is mixed and kneaded with an organic solvent to thereby transfer the colorant to the resin component, and the water and organic solvent are then removed. According to this process, a wet cake of the colorant can be used as intact without drying. A high shearing dispersing apparatus such as a three-roll mill can be preferably used in mixing and kneading.

Releasing Agent

Releasing agents utilized in the present invention may be selected from conventional agents. The releasing agents may be incorporated into toners by way of dissolving or dispersing into an organic solvent, for example. Releasing agents are broadly classified into polyolefin waxes such as polyethylene wax and polypropylene wax; long-chain hydrocarbons such as paraffin wax and Sasol wax, and waxes containing a carbonyl group; preferably are carbonyl-containing waxes among these. Examples of carbonyl-containing waxes include polyalkanoates such as carnauba wax, montan wax, trimethylolpropane tribehenate, pentaerythritol tetrabehenate, pentaerythritol diacetate dibehenate, glycerol tribehenate, 1,18-octadecanedioldistearate; polyalkanol esters such as tristearyl trimellitate, distearyl maleate; polyalkanoic acid amides such as ethylenediamine dibehenylamide; polyalkylamides such as tristearylamide trimellitate; and dialkyl ketones such as distearyl ketone, or the like.

In addition, crystalline polyester resins having a melting point may be possible. Among these carbonyl-containing waxes, polyalkanates and crystalline polyester resins are preferable, and more preferably is combination of two or more releasing agents having different melting points. Usually, the content of the releasing agent in toner is 0.4 to 40% by weight, preferably is 2 to 30% by weight, and more preferably is 3 to 25% by weight.

Charge Controlling Agent

The charge controlling agent, incorporated into the toner utilized optionally in the present invention, may be one or combination of conventional charge controlling agents such as metal chelates, metal salts of organic acids, metal-containing dyes, Nigrosine dies, amide-containing compounds, phenol compounds, naphthol compounds and metal salts thereof, urethane-bond-containing compounds, and acidic or electron-absorbing organic substances. Further, metal salts or complexes of salicylic acid or alkyl salicylic acid with chromium, zinc, and aluminum; metal salts or metal complexes of benzilic acid; amide compounds, phenol compounds, naphthol compounds, phenolamide compounds, hydroxynaphthalene compounds such as 4,4'-methylene bis [2-[N-(4-chlorophenyl)amide]-3-hydroxynaphthalene are preferable for negative charging ability form the view point of color toner compatibility i.e. no interference for toner color owing to colorless or pale color of the charge controlling agent itself. The content of charge controlling agent may be dependent on the desired charging amount of toner; usually is 0.01 to 10 parts by weight based on 100 parts by weight of toner, preferably is 0.1 to 10 parts by weight.

External Additive

Inorganic fine particles can be preferably used as the external additive to improve or enhance the fluidity, developing properties, and charging ability of the toner particles. Among them, hydrophobic silica and/or hydrophobic titanium oxide is typically preferred. The inorganic fine particles have a primary particle diameter of preferably from 5 nm to 2 μm, and more preferably from 5 nm to 500 nm and have a specific surface area as determined by the BET method of preferably from 20 $m^2/g$ to 500 $m^2/g$. The amount of the inorganic fine particles is preferably from 0.01% by weight to 5% by weight, and more preferably from 0.01% by weight to 2.0% by weight based on the toner.

Examples of inorganic fine particles include silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, and silicon nitride.

Other examples of the external additive are polymer particles such as polystyrene, copolymers of methacrylic esters or acrylic esters prepared by soap-free emulsion polymerization, suspension polymerization or dispersion polymerization; silicone resins, benzoguanamine resins, nylon resins, and other polycondensed or thermosetting resins.

A surface treatment is suitably performed on these external additives to improve hydrophobic property so that fluidity and charging ability are inhibited from being impaired even in a high humidity atmosphere. Suitable surface treatment agents are, for example, a silane coupling agent, sililating agent, silane coupling agent having a fluorinated alkyl group, organic titanate coupling agent, aluminium coupling agent, silicone oil, and modified silicone oil.

A cleaning agent or cleaning improver may also be added in order to remove the developer remained on a photoconductor or on a primary transfer member after transfer. Suitable cleaning agents are, for example, metal salts of stearic acid and other fatty acids such as zinc stearate, and calcium stearate; and poly(methyl methacrylate) fine particles, polystyrene fine particles, and other fine polymer particles prepared by, for example, soap-free emulsion polymerization. Such fine polymer particles preferably have a relatively narrow particle distribution and a volume-average particle diameter of 0.01 μm to 1 μm.

Circularity and Distribution of Circularity

Preferably, the toner utilized in the present invention has a certain shape and its distribution. The toner, having an average circularity of less than 0.90 or nonuniform shape excessively apart from spherical, may not lead to sufficient transferring ability or high quality images free from smears or defects. The circularity of the dry toner is preferably determined by an optical detection band method, wherein the particle-containing suspension is allowed to pass through a photographic detection band on a plate, and the particle images were optically detected/analyzed with a CCD camera. Average circularity can be obtained by dividing a boundary length of corresponding circle having an equal projected area by the boundary length of the measured particle. It is found that a toner having an average circularity of 0.94 to 0.96 is effective to form images with an appropriate density and high precision and reproducibility. The average circularity is more preferably from 0.945 to 0.955, and particles having circularity less than 0.94 is 10% or less.

When the average circularity is more than 0.96, inferior cleaning occurs at photoconductors or transferring belts in systems where blade cleaning is employed, resulting smears on images. Specifically, inferior cleaning is not a serious matter in general when area ratio of images is lower at developing or transferring, since toner residue is little at transferring; however, when area ratio of images is higher such as photographic images, inferior cleaning may be a serious matter. In addition, toner residue may be caused on photoconductors from a toner that forms untransferred images due to inferior paper feeding; inherent charging capacity may not appear due to smear of charging rollers when photoconductors are subjected to contact charging.

Ratio of Weight-Averaged Particle Diameter to Number-Averaged Particle Diameter

When toners that have a weight-averaged particle diameter Dw of 4 to 8 μm, and a ratio (Dw/Dn) of 1.25 or less, preferably 1.10 to 1.25, wherein Dn is a number-average particle diameter Dn, are utilized as dry toners, image gloss is superior in full-color copiers. Further, when the toner is used in a double-component developer, variation of the toner particle diameter is minimized even after repeating cycles of consumption and addition of the toner with respect to carrier. As the toner keeps a narrow average particle diameter without being affected by stirring in a developing device for a long period, the toner can keep stable and excellent developing properties. When the toner is used as a single-component developer, the variation of the toner particle diameter is minimized as in the double-component developer. In addition, toner filming to development rollers, and toner fusion of members such as a toner blade which control the toner thickness on the development roller are also prevented. Hence, even if the toner is used or stirred in the image developer for a long period of time, the toner can keep stable and excellent developing properties to form high-quality images stably.

It is generally believed that the smaller is toner diameter, the higher are the image resolution and image quality. However, toners having a smaller diameter are considered to be disadvantageous in transferring ability and cleaning ability. When a weight-averaged particle diameter of the toner is smaller than the range described above, the toner as a double-component developer tend to fuse onto a surface of carrier by being stirred in the image developing device for a long period of time and thus charging ability of the carrier is impaired. In addition, in the case of single-component developer, filming of the toner to developing rollers, and toner fusion to members such as blades which control the toner thickness on developing rollers tend to occur.

These phenomena tend to occur similarly in toners having higher content of fine particles.

On the contrary, when the particle diameter of toners is over the range described above, images with high resolution and high quality hardly yield, and particle diameter of toner often fluctuate when toner in developer is consumed. In addition, it is found that similar results appear when Dw/Dn is above 1.25.

Carrier

The toner of the present invention can be used as a two-component developer after mixed with a magnetic carrier. The content of the toner in the developer is preferably 1 to 10 parts by weight based on 100 parts by weight of the carrier. Any conventionally-known magnetic carrier, such as iron powder, ferrite powder, magnetite powder, magnetic resin carrier, can be used. Examples of resins for covering the surface of the carrier include amino resin, urea-formaldehyde resin, melamine resin, benzoguanamine resin, urea resin, polyamide resin and epoxy resin. Also usable for covering a carrier are polyvinyl or polyvinylidene resins; polystyrene resins such as acrylic resin, polymethyl methacrylate resin, polyacrylonitrile resin, polyvinyl acetate resin, polyvinyl alcohol resin, polyvinyl butyral resin, polystyrene resin and styrene-acrylic copolymer; halogenated olefin resins such as polyvinyl chloride resin; polyester resins such as polyethylene terephthalate resin and polybutylene terephthalate resin; polycarbonate resins; polyethylene resins; polyvinyl fluoride resins; polyvinylidene fluoride resins; polytrifluoroethylene resins; polyhesafluoropropylene resins; copolymers of vinylidene fluoride and an acrylic monomer; copolymers of vinylidene fluoride and vinyl fluoride; terpolymers of tetrafluoroethylene, vinylidene fluoride and a fluorine-free monomer; and silicone resins. The resin coating for the carrier may contain conductive powder such as metal powder, carbon black, titanium oxide, tin oxide or zinc oxide. The conductive powder preferably has an average particle size of 1 μm or less for reasons of easy control of the electric resistance. The toner utilized in the present invention may be used as a one-component magnetic or nonmagnetic toner requiring no carrier.

Production Process of Toner

The toner utilized in the present invention may be produced, but not limited to, by dissolving or dispersing a polymer having a site reactive with an active-hydrogen-containing compound, binder resin, colorant, and releasing agent, causing a reaction of the polymer having a site reactive with an active-hydrogen-containing compound with crosslinking or extension agent, i.e. the active-hydrogen-containing compound, then the organic solvent is removed during or after the reaction; thereafter, the reaction product is dispersed into a specific medium at certain particle diameter.

The dispersing procedure is not specifically limited and includes known procedures such as low-speed shearing, high-speed shearing, dispersing by function, high-pressure jetting, and ultrasonic dispersion. To allow the dispersion to have an average particle diameter of from 2 to 20 μm, the high-speed shearing procedure is preferred. When a high-speed shearing dispersing machine is used, the number of rotation is not specifically limited and is generally from 1,000 to 30,000 rpm and preferably from 5,000 to 20,000 rpm. The dispersion time is not specifically limited and is generally from 0.1 to 20 minutes in batch systems. The temperature at dispersing is usually 0 to 150° C. under application of pressure, preferably 10 to 98° C.

The amount of the aqueous medium is usually 50 to 2000 parts by weight based on 100 parts by weight of dispersion, preferably is 100 to 1000 parts by weight. When the amount is less than 50 parts by weight, the dispersing condition of the dispersion is poor, making impossible to take the desired particle diameter of toner particles; whereas over 20000 parts by weight is not economically feasible.

In addition, a dispersant may be employed. The dispersant is preferable in that the particle size distribution comes to more narrow and the dispersion is likely to be stable. Examples of the dispersant include water-soluble polymers such as polyvinyl alcohol, hydroxyethyl cellulose, and polyvinyl pyrrolidone; inorganic powders such as calcium carbonate powder, calcium phosphate powder, hydroxy appatite powder, and silica fine powder; and surfactants such as nonionic surfactant and anionic surfactant. Specific examples of anionic surfactant include fatty acid family such as sodium stearate, and sodium dodecanate; dodecyl sodiumsulfate, dodecyl benzenesodiumsulfonate, and lauryl sodiumsulfate. Specific examples of nonionic surfactant include polyoxyethylene dodecylether, polyoxyethylene hexadecylether, polyoxyethylene nonylphenylether, polyoxyethylene laurylether, polyoxyethylene sorbitanmonooleate, and monodecanoyl saccharose. In addition, emulsion polymers obtained by copolymerizing methacrylic acid for example may be utilized for efficiently and stably dispersing.

As for the organic solvent utilized in the present invention, conventional solvents that may dissolve the active-hydrogen-containing compounds, compounds having a site reactive with active-hydrogen-containing compounds, and binder resins. Preferably, the solvent is volatile and the boiling point is less than 100° C., since the solvent can be removed easily. Examples of the solvent include ethyl acetate, acetone, methylethylketone, and THF. The amount of the organic solvent is usually 10 parts by weight based on 100 parts by weight of dispersion, preferably is 20 to 400 parts by weight, and more preferably is 50 to 300 parts by weight. The way to remove the organic solvent from raw toner particles dispersed in the aqueous medium may be conventional removing way by means of heating and optional evacuating. During removing the organic solvent, the crosslinking reaction occurs between the compound having a site reactive with active-hydrogen-containing compounds and crosslinking or extension agent (i.e. an active-hydrogen-containing compound). The liquid containing raw toner particles is subjected to solid-liquid separation by means of centrifugal separator, Spacra filter, or filter press, then the resulting powder is dried, thereby the toner utilized in the present invention may be obtained. Examples of apparatuses for drying the powder include the apparatuses of air current, vibration and fluidization, fluidizing bed, evacuation, and circulated air types. These apparatuses may be used alone or in combination. Classification may be combined such as air classification in order to obtain an intended particle distribution.

Figure 5:
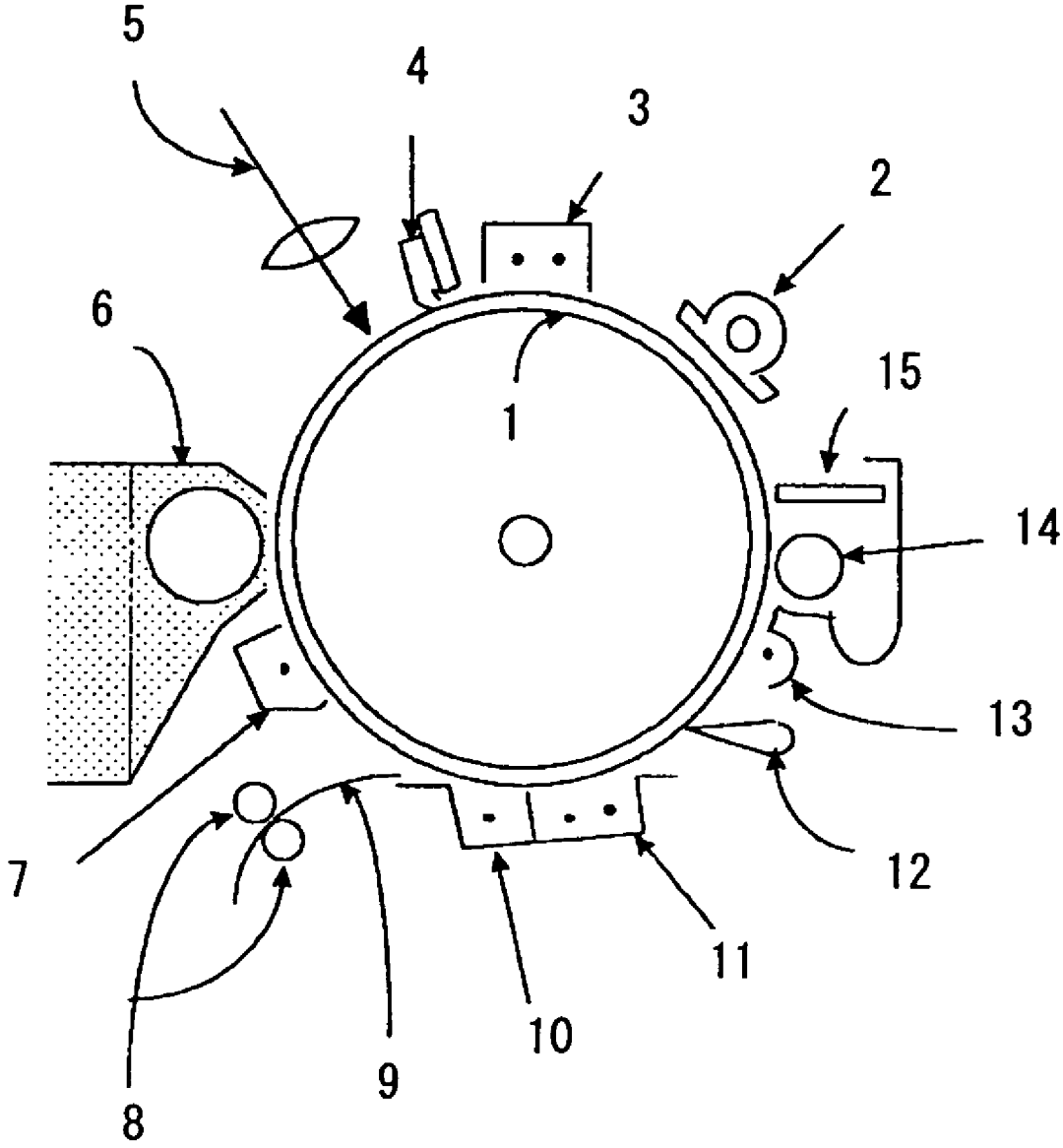
FIG. 5 schematically shows an exemplary image forming apparatus according to the present invention.

The image forming apparatuses according to the present invention will be explained referring to the attached figures. FIG. 5 schematically shows an exemplary image forming apparatus according to the present invention. By the way, the following modifications are included into the scope of the present invention.

As shown in FIG. 5, the image forming apparatus according to the present invention comprises photoconductor of drum-like shape (1), charging charger (3), pre-transferring charger (7), transferring charger (10), separating charger (11), and pre-cleaning charger (13). The shape of photoconductor (1) is not limited to drum-like shape, but may be sheet-like or endless belt-like. As for various chargers, corotron, scorotoron, solid charger, charging roller and the like may be utilized. These chargers may be applied to the transferring unit, the combined type of transferring charger and separating charger is effectively utilized.

The light source of image-irradiating portion (5), charge-eliminating lamp (2) and other members may be a fluorescent lamp, tungsten lamp, halogen lamp, mercury lamp, sodium lamp, light emitting diode (LED), semiconductor laser (LD) and electroluminescent (EL) lamp. To irradiate light of a desired wavelength alone, various filters may be utilized such as a sharp-cut filter, band pass filter, near-infrared cut filter, dichroic filter, interference filter and color conversion filter.

The light source works to apply light to the photoconductor in the process shown in FIG. 5, as well as in another process in combination with light irradiation, such as transferring process, charge-eliminating process, cleaning process or pre-exposing process.

The toner developed on the photoconductor (1) by action of the developing unit (6) is transferred to the transfer sheet (9), wherein all of the toner is not transferred, a minor portion of the toner remains on the photoconductor (1). The residual toner on the photoconductor (1) is removed from the photoconductor (1) by fur brush (14) and cleaning brush (15); the cleaning process may be performed with the cleaning brush alone. Examples of the cleaning brush include a fur brush, magnetic fur brush and any other conventional brushes.

When the electrophotographic photoconductor is positively (negatively) charged and image exposure is performed, a positive (negative) electrostatic latent image is formed on the electrophotographic photoconductor surface. When developed with a toner (charge-seeking particulates) of negative (positive) polarity, a positive image will be obtained, and when developed with a toner of positive (negative) polarity, a negative image will be obtained.

The image forming apparatuses according to the present invention may be equipped with a contacting member that contacts with the electrophotographic photoconductor and slide and scrub on it. The contacting member may comprise a contacting portion to slide and scrub with the exposed portion of the fine particles of fluorine-contained resin, alternatively the contacting member may be formed by additionally providing a pressurizing mechanism to an usual member in image forming apparatuses i.e. a contacting-charging member such as a charging roller, cleaning member such as a cleaning brush, and transferring member such as charging belt or intermediate charging member.

For example, the cleaning blade (15) will be discussed that slide and scribe the surface of the photoconductor. The cleaning blade slide and scribe approximately the entire surface of the photoconductor while urging the photoconductor surface with approximately uniform pressure, and performs a significant effect of adhering uniformly the fine particles of fluorine-contained resin on the surface.

When the fluorine-contained resin is covered by means of a cleaning blade, the following conditions of cleaning blade will be appropriate such as 10 to 30° of contacting angle, 0.3 to 4 g/mm of contacting pressure, 60 to 70 degrees of urethane rubber hardness for the blade, 30 to 70% of impact resilience, 30 to 60 kgf/cm$^2$ of modulus of elasticity, 1.5 to 3.0 mm of thickness, 7 to 12 mm of free length, 0.2 to 2 mm of blade edge interlocking into the photoconductor. In FIG. 5, (4) indicates an eraser, (8) indicates a resist roller, and (12) indicates a separating claw.

Figure 6:
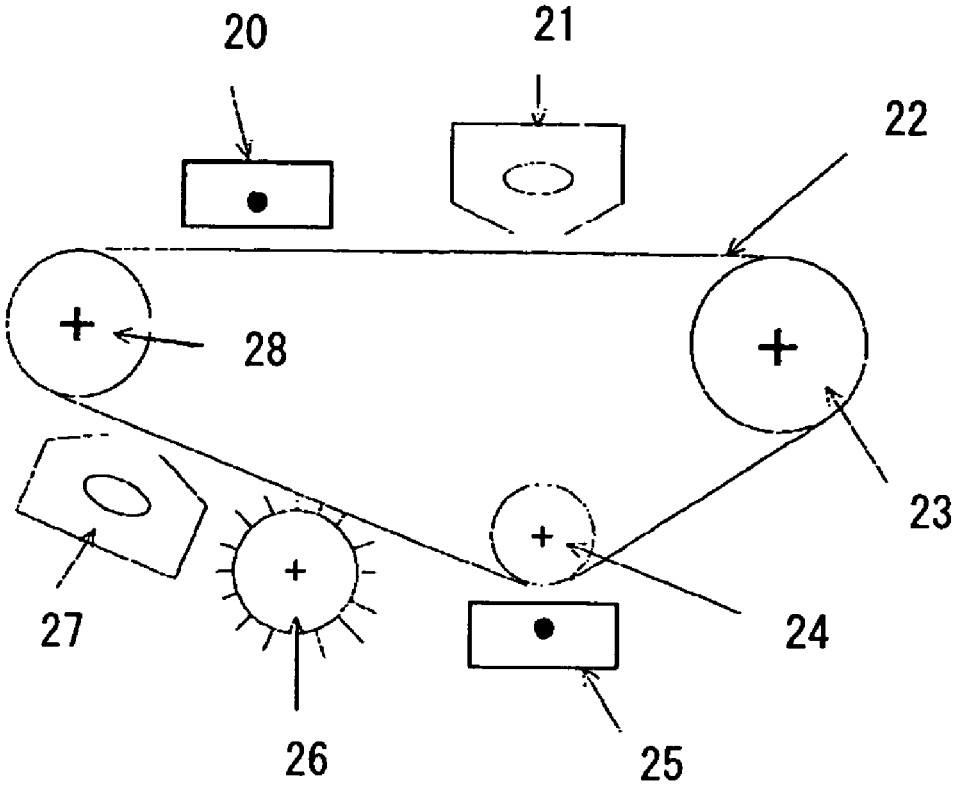
FIG. 6 schematically shows another exemplary image forming apparatus according to the present invention.

Another example of the electrophotographic process is shown in FIG. 6 that utilizes the image forming apparatus according to the present invention. The photoconductor (22) is driven by driving rollers (23) and is repeatedly subjected to charging by charging charger (20), to image exposure by light source (21), to developing (not shown), to transferring by transferring charger (25), to cleaning by cleaning brush (26), and to charge elimination by light source (27). In FIG. 6, (24) indicates a tension roller, and (28) indicates an obeying roller.

As for full-color image forming apparatuses, to which the present invention is applied, an aspect of printer of electrophotographic type (hereinafter, referring to "printer") will be discussed.

Figure 7:
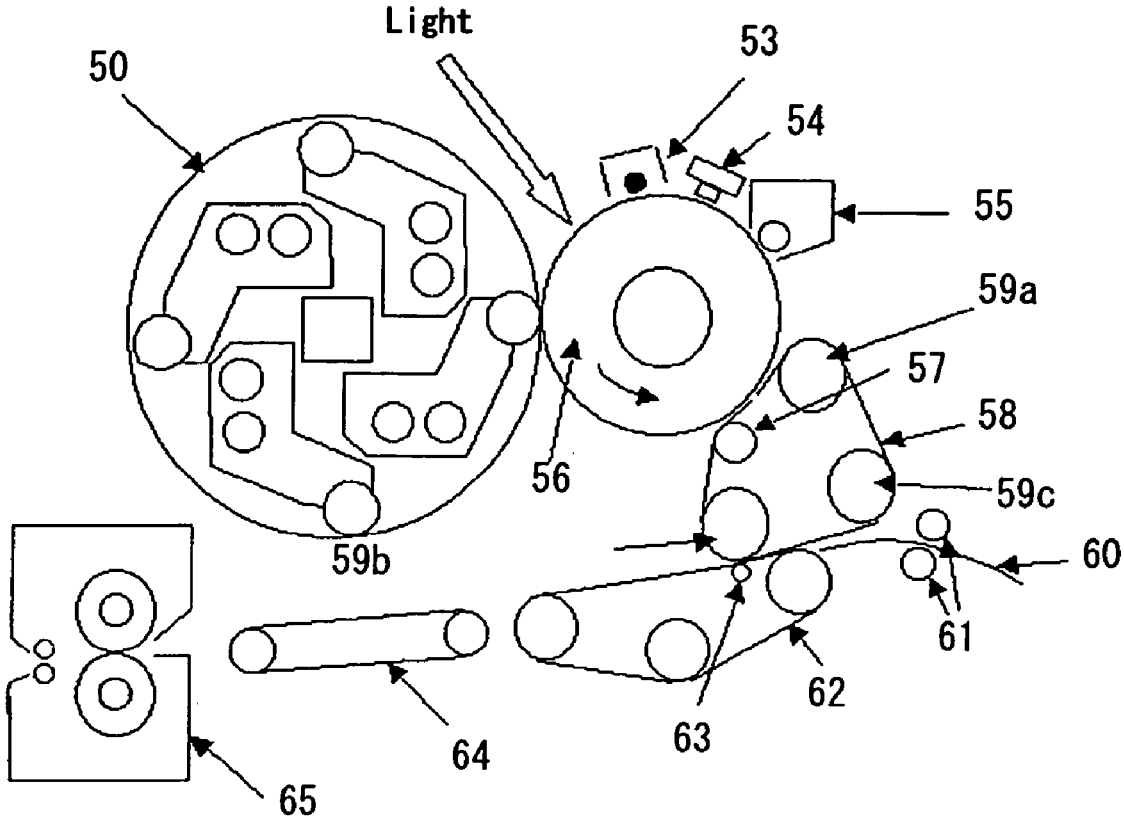
FIG. 7 schematically shows a printer that is an exemplary image forming apparatus according to the present invention.

FIG. 7 shows a schematic constitution of the printer to which the present invention is applied. In FIG. 7, while photoconductor (56), which is a latent image bearing member, is driven to rotate toward the anticlockwise direction in FIG. 7, the surface is charged uniformly by charging charger (53) equipped with corotron or scorotron, then the photoconductor (56) bears latent images through receiving the scanning laser L from a laser apparatus (not shown). The scanning is carried out by the mono-color information of yellow, magenta, cyan, and black based on the full-color image, therefore, the mono-color electrostatic latent images of yellow, magenta, cyan, and black are formed on the photoconductor (56). Revolving developing unit (50) is disposed at the left side of the photoconductor (56) as shown in FIG. 7. The unit (50) comprises a yellow developer, magenta developer, cyan developer, and black developer in the revolving drum-like housing, the respective developers are moved in sequence to the opposite developing site of photoconductor (56) through revolving motion. The yellow developer, magenta developer, cyan developer, and black developer respectively cause the adhesion of yellow toner, magenta toner, cyan toner, and black toner, thereby to develop the electrostatic latent images. The electrostatic latent images of yellow, magenta, cyan, and black images are formed in sequence, and are developed by the respective revolving developer of revolving developing unit 50 in sequence, thereby yellow, magenta, cyan, and black toner images are formed.

An intermediate transferring unit is disposed at the downstream from the developing site in the revolution direction of the photoconductor drum (56). The intermediate transferring unit is activated by rotating endlessly in clockwise direction the intermediate transferring belt (58), tensioned on tension roller (59*a*), intermediate transferring bias roller (57) as transferring unit, secondary transferring backup roller (59*b*), and belt driving roller (59*c*), by the rotating force of the belt driving roller (59*c*). The yellow toner image, magenta toner image, cyan toner image, and black toner image developed on the photoconductor drum (56) progress into the intermediate nip where photoconductor drum (56) and intermediate transferring belt make contact. Then the color image formed of overlapped four colors is produced by overlapping on intermediate transferring belt (58) under the effect of the bias from the intermediate transferring bias roller (57).

The surface of photoconductor drum (56), passed through the nip with the revolution, is subjected to cleaning of the residual toner by drum cleaning unit (55). Drum cleaning unit (55), which cleans the residual transferring toner by a cleaning roller to which cleaning bias is applied, may equipped with a cleaning brush such as far brush or magnetic fur brush, or a cleaning blade.

The surface of the photoconductor drum (56), where the residual toner is cleaned, is subjected to charge elimination by charge eliminating lamp (54). The charge eliminating lamp (54) may be a fluorescent lamp, tungsten lamp, halogen lamp, mercury lamp, sodium lamp, light emitting diode (LED), semiconductor laser (LD) and electroluminescent (EL) lamp. To irradiate light of desired wavelengths alone, various filters may be utilized such as a sharp-cut filter, band pass filter, near-infrared cut filter, dichroic filter, interference filter and color conversion filter.

On the other hand, the resistant roller pair (61), which nips between the two rollers the transferring paper (60) from the feeding paper cassette (not shown), feeds the transferring paper (60) to the secondary transferring nip in a timing that the transferring paper (60) can be overlapped to the four color duplicated toner image on the intermediate transferring belt (58). The four color duplicated toner image on the intermediate transferring belt (58) is transferred together on the transferring paper (60) under the effect of the secondary transferring bias from the paper transferring bias roller (63) in the secondary transferring nip. Owing to the secondary transfer, full-color images may be formed on the transferring paper.

The transferring paper bearing the full-color image is sent to conveying belt (64) by transferring belt (62). Transferring belt (64) feeds the transferring paper (60) from the transferring unit into fixing unit (65). The fixing unit (65) conveys the sent transferring paper (60) while nipping it between the fixing nip formed by contacting the heating roller and backup roller. The full-color image on the transferring paper (60) is fixed on the transferring paper (60) under the effects of heat and pressure from the heating roller and the fixing nip.

Further, a bias (not shown) is applied to the transferring belt (62) and conveying belt (64), in order to adsorb the transferring paper (60). Furthermore, a paper-discharging charger to discharge transferring paper (60), and three belt-discharging charger are disposed to discharge the respective belts of intermediate belt (58), transferring belt (62), and conveying belt (64). The intermediate transferring unit also comprises a belt-cleaning unit of which constitution is similar to the drum-cleaning unit (55), thereby the residual toner on the intermediate transferring belt (58) is cleaned.

Figure 8:
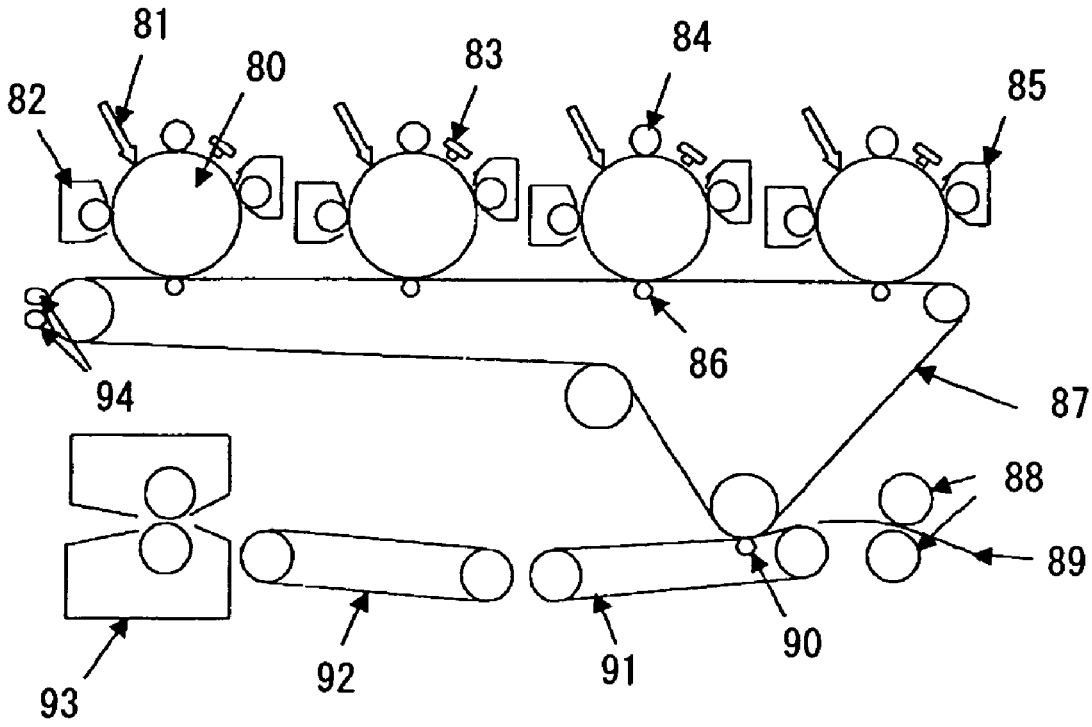
FIG. 8 schematically shows another printer that is an exemplary image forming apparatus according to the present invention.

FIG. 8 shows another aspect of the electrophotographic apparatus according to the present invention. The apparatus is an image forming apparatus of tandem type having an intermediate-transferring belt (87), in which the apparatus involves photoconductor drums (80Y), (80M), (80C) and (80Bk) individually for respective colors, rather than one photoconductor drum (80) is shared by all of the colors. Further, drum-cleaning unit (85), charge-eliminating lamp (83), and charging roller (84) to charge the drum uniformly are equipped for the respective colors. By the way, the printer shown in FIG. 7 is equipped with charging charger (53) as the unit to charge the drum uniformly, whereas the apparatus is equipped with charging roller (84).

In addition, the image forming apparatus shown in FIG. 8 is equipped with light source (81), developing unit (82), bias roller (86), resist roller (88), transferring paper (89), transferring bias roller (90), transferring belt (91), conveying belt (92), fixing unit (93), and fur brush (94). In such tandem type, the latent image forming and the developing may be carried out for the respective colors in parallel, therefore, the speed of image forming may be enhanced more easily than the revolving type.

EXAMPLES

The present invention will be illustrated in further detail with reference to several examples and comparative examples below, which are never intended to limit the scope of the present invention. In the followings, "parts" written in below refers to "parts by weight".

Example 1 of Toner Production

Preparation of Organic Fine Particle Emulsion

Fine Particle Dispersion 1

Into a reactor equipped with a stirring rod and a thermometer were poured 683 parts of water, 6 parts of sodium sulfate of ethylene oxide adduct of methacrylic acid (ELEMINOL RS-30, by Sanyo Chemical Industries, Ltd.), 85 parts of styrene, 85 parts of methacrylic acid, 111 parts of butyl acrylate, and 1 part of ammonium persulfate, and the mixture was stirred at 400 rpm for 15 minutes to yield a white emulsion. The emulsion was heated to an inner temperature of 75° C., followed by allowing to react for 5 hours. The reaction mixture was further treated with 30 parts of 1% aqueous solution of ammonium sulfate, and was aged at 75° C. for 5 hours, thereby yielding an aqueous dispersion of Fine Particle Dispersion 1 of a vinyl resin (copolymer of styrene-methacrylic acid-butyl acrylate-sodium sulfate of ethylene oxide adduct of methacrylic acid). Fine Particle Dispersion 1 had a weight-averaged particle diameter of 300 nm when measured with a laser diffraction-scattering size distribution analyzer LA-920 (trade name, available from Horiba, Ltd., Japan). Part of Fine Particle Dispersion 1 was dried to isolate the resin component. The resin component had a glass transfer temperature Tg of 78° C., number-averaged molecular weight of 2100, and weight-average molecular weight of 9900.

Fine Particle Dispersion 2

Into a reactor equipped with a stirring rod and a thermometer were poured 683 parts of water, 5 parts of sodium sulfate of ethylene oxide adduct of methacrylic acid (ELEMINOL RS-30, by Sanyo Chemical Industries, Ltd.), 81 parts of styrene, 81 parts of methacrylic acid, 107 parts of butyl acrylate, 13 parts of 1,6-hexanediol diacrylate and 1 part of ammonium persulfate, and the mixture was stirred at 400 rpm for 15 minutes to yield a white emulsion. The emulsion was heated to an inner temperature of 75° C., followed by allowing to react for 5 hours. The reaction mixture was further treated with 30 parts of 1% aqueous solution of ammonium sulfate, and was aged at 75° C. for 5 hours, thereby yielding an aqueous dispersion of Fine Particle Dispersion 2 of a vinyl resin (copolymer of styrene-methacrylic acid-butyl acrylate-sodium sulfate of ethylene oxide adduct of methacrylic acid). Fine Particle Dispersion 2 had a weight-averaged particle diameter of 295 nm when measured with a laser diffraction-scattering size distribution analyzer LA-920 (by Horiba, Ltd.). Part of Fine Particle Dispersion 2 was dried to isolate the resin component. The resin component had a glass transfer temperature Tg of 105° C., number-averaged molecular weight of 10,000, and weight-average molecular weight of 1,000,000.

Preparation of Low-Molecular Weight Polyester

Into a reactor equipped with a condenser, stirrer, and nitrogen gas inlet were poured 220 parts of ethylene oxide (2 mole) adduct of bisphenol A, 561 parts of propylene oxide (3 mole) adduct of bisphenol A, 208 parts of terephthalic acid, 46 parts of adipic acid, and 2 parts of dibutyltin oxide. The mixture was reacted at 230° C. at ambient pressure for 8 hours and was further reacted at reduced pressure of 10 to 15 mmHg for 5 hours. The reaction mixture was further treated with 44 parts of trimellitic anhydride at 180° C. at ambient pressure for 1.8 hours, thereby yielding Low-Molecular Weight Polyester 1.

Preparation of Prepolymer

Into a reactor equipped with a condenser, stirrer, and nitrogen gas inlet were poured 682 parts of ethylene oxide (2 mole) adduct of bisphenol A, 81 parts of a propylene oxide (2 mole) adduct of bisphenol A, 283 parts of terephthalic acid, 22 parts of trimellitic anhydride, and 2 parts of dibutyltin oxide. The mixture was reacted at 230° C. at ambient pressure for 8 hours, was further reacted under a reduced pressure of 10 to 15 mmHg for 5 hours, thereby yielding Intermediate Polyester 1 having a number-average molecular weight of 2100, weight-average molecular weight of 9500, Tg of 55° C., acid value of 0.5, and hydroxyl value of 49.

Into a reactor equipped with a condenser, stirrer, and nitrogen gas inlet were poured 411 parts of Intermediate Polyester 1, 89 parts of isophorone diisocyanate, and 500 parts of ethyl acetate, followed by allowing to react at 100° C. for 5 hours to yield Prepolymer 1.

Synthesis of Ketimine

Into a reactor equipped with a stirring rod and a thermometer were poured 170 parts of isophoronediamine and 75 parts of methylethylketone, followed by allowing to react at 50° C. for 5 hours to yield Ketimine Compound 1.

Preparation of Oil Phase

Into a reactor equipped with a stirring rod and a thermometer were poured 628 parts of Low-molecular Weight Polyester 1, 110 parts of carnauba wax, 22 parts of CCA (metal complex of salicylic acid E-84, by Orient Chemical Industries Ltd.), and 947 parts of ethyl acetate. The mixture was heated at 80° C. for 5 hours with stirring and was then cooled to 30° C. over 1 hour. Then, 250 parts of carbon black (Regal 400R, Cabot Co.) and 500 parts of ethyl acetate were poured into the reactor and mixed for one hour to prepare Raw Material Solution 1.

Next, 1324 parts of Raw Material Solution 1 was placed in a vessel, and the carbon black and wax components therein were dispersed using a bead mill (ULTRAVISCO-MILL, by Aimex Co., Ltd.) at liquid feeding speed of 1 kg/hr, disc rotation speed of 6 m/sec., using zirconia beads 0.5 mm in diameter filled 80% by volume at a repetitive number. The dispersing procedure was repeated a total of three times. The dispersion was further treated with 1324 parts of a 65% ethyl acetate solution of Low-molecular Weight Polyester 1, and the mixture was dispersed under the above conditions except that the dispersion procedure was performed once to yield Pigment-wax Dispersion 1.

Preparation of Oil Phase Mixture

Oil Phase Mixture 1 was prepared by pouring 648 parts of Pigment-wax Dispersion 1, 154 parts of Prepolymer 1, and 6.6 parts of Ketimine Compound 1 into a vessel, and mixing at 5,000 rpm for 1 minute by means of T.K. HOMO MIXER (Tokushu Kika Kogyo Co., Ltd.).

Emulsification and Solvent Removal

Into a vessel were poured 990 parts of water, 72 parts of Fine Particle Dispersion 1, 8 parts of Fine Particel Dispersion 2, 40 parts of 48.5% aqueous solution of dodecyldiphenylether sodiumdisulfonate (ELEMINOL MON-7, by Sanyo Chemical Industries, Ltd.), and 90 parts of ethyl acetate, and the is mixture was mixed at 3000 rpm for 1 minute using a T.K. HOMO MIXER (Tokushu Kika Kogyo Co., Ltd.). Next, 809 parts of Oil Phase Mixture 1 was added to, the mixture was dispersed at 13000 rpm for 20 minutes using a T.K. HOMO MIXER, thereby yielding Emulsified Slurry 1.

Into a vessel equipped with a stirrer and a thermometer was poured Emulsified Slurry 1 and was heated at 30° C. for 8 hours to remove the solvent therefrom. The slurry was aged at 45° C. for 4 hours and thereby yielded Dispersed Slurry 1. The Dispersed Slurry 1 exhibited a weight-averaged particle diameter of 4.95 μm and a number-averaged particle diameter of 4.45 μm (measured by Multi-Sizer II).

Washing and Drying

A total of 100 parts of Emulsified Slurry 1 was filtered under a reduced pressure and was washed by the following procedures.

(1) The filtered cake and 300 parts of de-ionized water were mixed in a T.K. HOMO MIXER at 12000 rpm for 10 minutes, and the mixture was filtered. This procedure was repeated 3 tomes to prepare Filtered Cake 1.

(2) The Filtered Cake prepared in (1) was dried at 45° C. for 48 hours in a circulating air dryer, was sieved with a 75 μm mesh sieve thereby to yielded a toner. To the resulting toner of 100 parts, 0.7 part of hydrophobic silica and 0.3 part of hydrophobic titanium oxide were blended by means of Henschel mixer to prepare Toner 1.

Example 2 of Toner Production

Preparation of Organic Fine Particle Emulsion

Fine Particle Dispersion 3

Fine Particle Dispersion 3 was prepared in the same manner as Fine Particle Dispersion 2, except for changing 5 parts of sodium sulfate of ethylene oxide adduct of methacrylic acid (ELEMINOL RS-30, by Sanyo Chemical Industries, Ltd.), 81 parts of styrene, 81 parts of methacrylic acid, 107 parts of butyl acrylate, and 13 parts of 1,6-hexanediol diacrylate, into 21 parts of sodium sulfate of ethylene oxide adduct of methacrylic acid (ELEMINOL RS-30, by Sanyo Chemical Industries, Ltd.), 77 parts of styrene, 77 parts of methacrylic acid, 103 parts of butyl acrylate, and 13 parts of 1,6-hexanediol diacrylate.

Fine Particle Dispersion 3 had a weight-averaged particle diameter of 42 nm when measured with a size distribution analyzer LA-920 (Horiba, Ltd.). Part of Fine Particle Dispersion 3 was dried to isolate the resin component. The resin component had a glass transfer temperature Tg of 107° C., number-averaged molecular weight of 320,000, and weight-average molecular weight of 2,100,000.

Fine Particle Dispersion 4

Fine Particle Dispersion 4 was prepared in the same manner as Fine Particle Dispersion 1, except for changing 6 parts of sodium sulfate of ethylene oxide adduct of methacrylic acid (ELEMINOL RS-30, by Sanyo Chemical Industries, Ltd.), 85 parts of styrene, 85 parts of methacrylic acid, and 111 parts of butyl acrylate, into 21 parts of sodium sulfate of ethylene oxide adduct of methacrylic acid (ELEMINOL RS-30, by Sanyo Chemical Industries, Ltd.), 80 parts of styrene, 80 parts of methacrylic acid, and 106 parts of butyl acrylate.

Fine Particle Dispersion 4 had a weight-averaged particle diameter of 40 nm when measured with a size distribution analyzer LA-920 (Horiba, Ltd.). Part of Fine Particle Dispersion 4 was dried to isolate the resin component. The resin component had a glass transfer temperature Tg of 79° C., number-averaged molecular weight of 300,000, and weight-average molecular weight of 3,000,000.

Toner 2 was prepared in the same manner as Toner Producing Example 1 except for changing Fine Particle Dispersion 1 into 40 parts of Fine Particle Dispersion 3 and changing Fine Particle Dispersion 2 into 40 parts of Fine Particle Dispersion 4.

Example 1 of Photoconductor Production

A coating liquid for undercoat layer was prepared as follows: 150 parts of an alkyd resin (Becolite M6401-50, by Dainippon and Chemicals, Co.) and 10 parts of melamine resin (Super Beckamine G-821-60, by Dainippon and Chemicals, Co.) were dissolved into 150 parts of methylethylketone, and titanium oxide powder (Tie Pail CR-EL, by Ishihara Sangyo Co. Ltd.) was added to the solution, then the mixture was subjected to milling for 12 hours to prepare a coating liquid for undercoat layer.

The coating liquid was coated on an aluminum substrate of 90 mm in diameter by 392 mm in length, and dried at 130° C. for 120 minutes, to form an undercoat layer in 3.5 μm thick.

Then 4 parts of polyvinylbutyral resin (XYHL, by UCC Co.), having formula (1) shown below, was dissolved into 150 parts of cyclohexane.

(1)

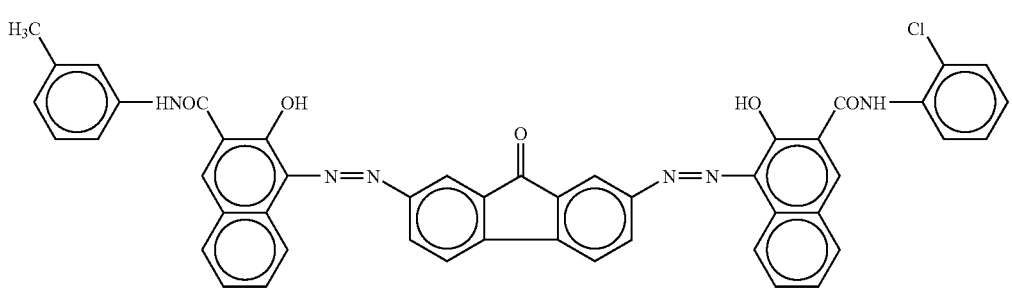

Then, 10 parts of bisazo pigment was added to the silution, and was subjected to dispersion by means of a ball moll; then 210 parts of cyclohexane was added and further subjected to dispersion for 3 hours. The liquid was recovered in a vessel and diluted by cyclohexane to a solid content of 1.5% by weight. The resulting coating liquid for charge generating layer was coated on the intermediate layer, and dried at 130° C. for 20 minutes to form a charge generating layer of 0.2 μm thick.

Then, 10 parts of bisphenol Z type polycarbonate resin and 0.002 part of silicone oil (KF-50, by Shin-Etsu Chemical Co. Ltd.) were dissolved into 100 parts of tetrahydrofuran, then 10 parts of charge transporting substance, having formula (2) shown below, was added to the solution to prepare a coating liquid for charge transporting layer. The resulting coating liquid for charge transporting layer was coated on the charge generating layer by dip coating, and was dried at 110° C. for 20 minutes to form a charge transporting layer of 20 μm thick.

(2)

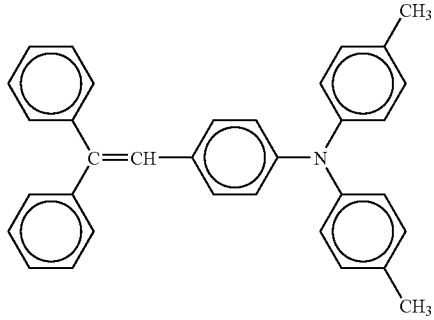

Then, to the mixed solvent of 60 parts of tetrahydrofuran and 20 parts of cyclohexanone, 18 parts of perfluoroalkoxy resin (PFA) (MPE-056, by Mitsui-DuPont Fluorochemical Co.) and 2 parts of dispersant (Modiper F210, by NOF Co.) were added, and subjected to circulating for 1 hour at 100 MPa pressure by means of a high-speed collision dispersion apparatus (Ultimaizer HJP-25005, by Sugino Machine Limited), thereby PFA dispersion was prepared.

Further, to the mixed solvent of 420 parts of tetrahydrofuran and 120 parts of cyclohexanone, 16 parts of the resin having formula (A) shown below was dissolved to prepare a resin solution. To the resin solution, 55 parts of the PFA dispersion was added and subjected to ultrasonic dispersing for 10 minutes to prepare a coating liquid for protective layer.

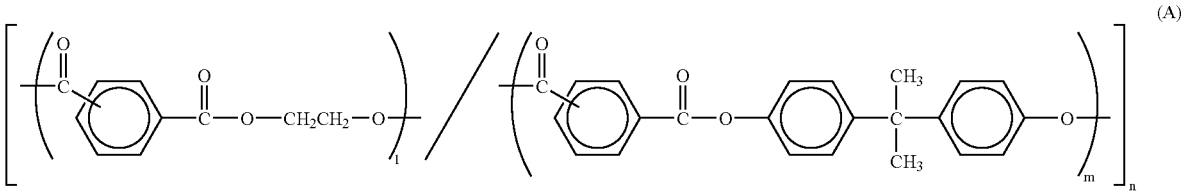

(A)

(l, m: mole ratio, l = 0.32, m = 0.68)

The coating liquid for protective layer was coated 3 times on the charge transporting layer through spray coating by means of a spray gun (Peacecon PC308, by Olinpos Co., 2 kg/cm$^2$ of air pressure) and drying at 30° C. for 60 minutes to form a protective layer of about 5 μm thick, thereby Photoconductor 1 was prepared.

Example 2 of Photoconductor Production

Photoconductor 2 was prepared in the same manner as Photoconductor 1, except for changing the resin of formula (A) into the resin of formula (B).

Comparative Example 1 of Photoconductor Production

Comparative Photoconductor 1 was prepared in the same manner as Photoconductor 1, except for changing the resin of formula (A) into the bisphenol Z type polycarbonate resin.

Comparative Example 2 of Photoconductor Production

Comparative Photoconductor 2 was prepared in the same manner as Photoconductor 1, except for changing the resin of formula (A) into polyalylate resin (U-100, Unitika Ltd.).

Comparative Example 1 of Toner Production

Comparative Toner 1 was prepared in the same manner as Photoconductor 1, except for changing 72 parts of Fine Particle Dispersion 1 into 40 parts, and Fine Particle Dispersion 2 into 40 parts of Fine Particle Dispersion.

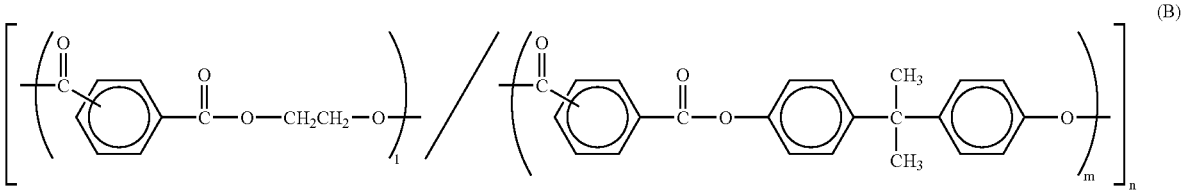

(B)

(l, m: mole ratio, l = 0.32, m = 0.68)

Evaluation (a) Photoconductors 1 and 2, Comparative Photoconductor 1 and 2 were mounted to a full-color laser printer Imagio Color 8100 (by Ricoh Company, Ltd.) and were evaluated along with Toners 1 and 2, Comparative Toner 1 as follows.

Using a developer formed from 5% by weight of above noted Toner and 95% by weight of Cu—Zn ferrite carrier coated with silicone resin and having an average particle size of 40 μm, and adjusting the charger voltage such that voltage at non-exposed portions (VD) was −700V, then running tests were respectively carried out such that 50000 sheets of A4 size were printed by writing in 600 dpi and 5% of image area ratio at 35° C. and 90% relative humidity; after and before the respective running test, a test pattern for evaluating abnormal was outputted, then abnormal images such as decrease of resolution, voids of halftone, and thickening of narrow lines were evaluated. Further, the decrease of film thickness was determined after the running test.

(b) Similar evaluations with (a) were conducted at the condition of 25° C. and 45% relative humidity. The results were shown in Table 1

TABLE 1

| | Toner | Photoconductor | Running Condition | Evaluation of Abnormal Images | Abration Wear (μm) |
|---|---|---|---|---|---|
| Ex. 1 | Toner 1 | Photoconductor 1 | 35° C. 90% | Good, no problem | 2.0 |
| Ex. 2 | Toner 1 | Photoconductor 2 | 35° C. 90% | Good, no problem | 2.2 |
| Ex. 3 | Toner 1 | Photoconductor 1 | 25° C. 45% | Good, no problem | 1.8 |
| Ex. 4 | Toner 1 | Photoconductor 2 | 25° C. 45% | Good, no problem | 1.8 |
| Ex. 5 | Toner 2 | Photoconductor 1 | 35° C. 90% | Good, no problem | 2.1 |
| Ex. 6 | Toner 2 | Photoconductor 2 | 35° C. 90% | Good, no problem | 1.9 |
| Ex. 7 | Toner 2 | Photoconductor 1 | 25° C. 45% | Good, no problem | 1.8 |
| Ex. 8 | Toner 2 | Photoconductor 2 | 25° C. 45% | Good, no problem | 1.9 |
| Comp. Ex. 1 | Toner 1 | Comp. Photoconductor 1 | 35° C. 90% | Decrease of resolution Thickening of narrow lines | 3.1 |
| Comp. Ex. 2 | Toner 1 | Comp. Photoconductor 1 | 25° C. 45% | Decrease of resolution Thickening of narrow lines Voids of halftone | 2.9 |
| Comp. Ex. 3 | Toner 2 | Comp. Photoconductor 2 | 35° C. 90% | Some decrease of resolution Slight thickening of narrow lines | 1.8 |
| Comp. Ex. 4 | Toner 2 | Comp. Photoconductor 2 | 25° C. 45% | Some decrease of resolution Slight thickening of narrow lines | 1.6 |
| Comp. Ex. 5 | Comp. Toner 1 | Photoconductor 1 | 35° C. 90% | Filming Deposition of contaminant | 1.4 |
| Comp. Ex. 6 | Comp. Toner 1 | Photoconductor 1 | 25° C. 45% | Filming Deposition of contaminant | 1.6 |

What is claimed is:

1. An image forming apparatus comprising:

an electrophotographic photoconductor, a charging unit configured to charge the electrophotographic photoconductor, a light exposure unit configured to expose light onto the charged electrophotographic photoconductor to form a latent electrostatic image, a developing unit loaded with a toner and configured to visualize the latent electrostatic image by depositing the toner to form a visual image, a transferring unit configured to transfer the visual image onto a recording medium, and a fixing unit configured to fix the visual image transferred onto the recording medium, wherein the electrophotographic photoconductor comprises a photosensitive layer on a conductive support wherein an outermost surface of the photosensitive layer comprises:

fluoropolymer fine particles; and a binder resin; wherein the fluoropolymer fine particles comprise primary particles, and secondary particles, the secondary particles are formed by flocculation of plural primary particles, and a part of the fluoropolymer fine particles comprising the primary particles and the secondary particles are exposed above the surface of the outermost layer, and each fluoropolymer fine particle as an average diameter, D, of exposed portion above the surface of the outermost surface of 0.15 μm≦D≦3.0 μm and a total area ratio of the fluoropolymer fine particles comprising the primary particles and the secondary particles is 10% to 60% based on the entire surface area of the outermost layer, and the binder resin in the outermost layer comprises a polyalylate copolymer resin having a structural unit of alkylene-aryldicarboxylate.

2. The image forming apparatus according to claim 1, wherein the polyalylate copolymer resin having a structural unit of alkylene-aryldicarboxylate is the polyalylate copolymer resin expressed by the general formula (I):

(I)

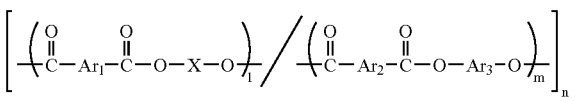

wherein $Ar_1$, $Ar_2$, and $Ar_3$ are each independently a substituted or unsubstituted aryl group, X is an alkylene group, said substituent group is a halogen atom or alkyl group; 1 and m are each a mole ratio in relation of 0.05≦1<0.6, 0.4≦m<0.95,1+m=1; n is a positive integer that satisfies the copolymer to have a weight-averaged molecular weight of $1\times10^3$ to $1\times10^6$ in terms of polystyrene.

3. The image forming apparatus according to claim 1, wherein the polyalylate copolymer resin having a structural unit of alkylene-aryldicarboxylate is the polyalylate copolymer resin expressed by the general formula (II):

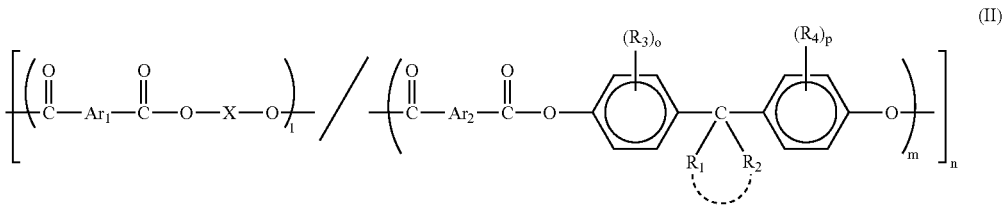

(II)

wherein $Ar_1$ and $Ar_2$ are each independently a substituted or unsubstituted aryl group, X is a divalent alkylene group, said substituent group is a halogen atom or alkyl group; $R_1$ and $R_2$ are each independently a hydrogen atom, alkyl group, or aryl group, and may be cyclic; $R_3$ and $R_4$ are each independently a hydrogen atom, halogen atom, or alkyl group; o and p are each an integer of 1 to 4, and may identical or different in case of 2 or more; 1 and m are each a mole ratio in relation of $0.05 \leqq 1 < 0.6$, $0.4 \leqq m < 0.95$, and $1+m=1$; n is a positive integer that satisfies the copolymer to have a weight-averaged molecular weight of $1\times10^3$ to $1\times10^6$ in terms of polystyrene.

4. The image forming apparatus according to claim 2, wherein $Ar_1$ and $Ar_2$ of the polyalylate copolymer resin expressed by the general formula (I) are each a phenylene group.

5. The image forming apparatus according to claim 3, wherein $Ar_1$ and $Ar_2$ of the polyalylate copolymer resin expressed by the general formula (II) are each a phenylene group.

6. The image forming apparatus according to claim 2, wherein the alkylene group X of the polyalylate copolymer resin expressed by the general formula (I) is an ethylene group.

7. The image forming apparatus according to claim 3, wherein the alkylene group X of the polyalylate copolymer resin expressed by the general formula (II) is an ethylene group.

8. The image forming apparatus according to claim 1, wherein a sum of area ratios of exposed portions of the fluorochemical fine particles above the surface of the outermost layer, is 10% to 60% based on the entire surface area of the outermost layer, and each of the primary and secondary particles has an average diameter of 0.2 to 1.5 μm.

9. The image forming apparatus according to claim 1, wherein a volume ratio of the fluoropolymer fine particles in the outermost layer of the electrophotographic photoconductor is 20% by volume to 70% by volume.

10. The image forming apparatus according to claim 1, wherein a content of the fluoropolymer fine particles in the photosensitive layer is higher at a side opposite to a side facing the conductive support than a side facing the conductive support.

11. The image forming apparatus according to claim 1, wherein the electrophotographic photoconductor comprises a protective layer on the photosensitive layer, the photosensitive layer comprises a charge generating substance and a charge transporting substance, the protective layer is laminated on the photosensitive layer, and the protective layer comprises a binder resin and fluoropolymer fine particles.

12. The image forming apparatus according to claim 1, wherein the electrophotographic photoconductor comprises a charge transporting substance at an outermost layer.

13. The image forming apparatus according to claim 1, wherein the image forming apparatus comprises a contacting member that contacts with, slides on and cleans the outermost surface of the electrophotographic photoconductor.

14. The image forming apparatus according to claim 13, wherein the fluoropolymer fine particles, contained in the outermost layer of the electrophotographic photoconductor, are extended over the surface of the outermost layer that contacts with the contacting member.

15. The image forming apparatus according to claim 1, wherein the image forming apparatus is of a tandem type that comprises plural electrophotographic photoconductors, charging units, light exposure units, developing units, and transferring units.

16. The image forming apparatus according to claim 1, wherein the image forming apparatus comprises an intermediate transferring unit configured to transfer primarily a toner image developed on the electrophotographic photoconductor to an intermediate transferring body, then to transfer secondarily the toner image on the intermediate transferring body onto a recording medium, and wherein a color image is formed through overlapping plural toner images each having individual color in turn on the intermediate transferring body, and the color image is secondarily transferred at the same time on the recording medium.

17. A process cartridge for an image forming apparatus, comprising:

an electrophotographic photoconductor, and a developing unit loaded with a toner and configured to visualize the latent electrostatic image by depositing the toner to form a visual image, wherein the electrophotographic photoconductor comprises a photosensitive layer on a conductive support wherein an outermost surface of the photosensitive layer comprises:

fluoropolymer fine particles; and a binder resin; wherein the fluoropolymer fine particles comprise primary particles, and secondary particles, the secondary particles are formed by flocculation of plural primary particles, and a part of the fluoropolymer fine particles comprising the primary particles and the secondary particles are exposed above the surface of the outermost layer, and each fluoropolymer fine particle has an average diameter, D, of exposed portion above the surface of the outermost surface of 0.15 μm $\leqq D \leqq$ 3.0 μm and a total area ratio of the fluoropolymer fine particles comprising the primary particles and the secondary particles is 10% to 60% based on the entire surface area of the outermost layer, the binder resin in the outermost layer comprises a polyalylate copolymer resin having a structural unit of alkylene-aryldicarboxylate, and the process cartridge is attachable and detachable to a main body of the image forming apparatus.

* * * * *